US006496991B1

(12) United States Patent
Votel

(10) Patent No.: US 6,496,991 B1
(45) Date of Patent: Dec. 24, 2002

(54) DEVICE FOR PATIENT PULLUP, ROLLOVER, AND TRANSFER AND METHODS THEREFOR

(75) Inventor: Thomas W. Votel, St. Paul, MN (US)

(73) Assignee: Ergodyne Corporation, St. Paul, MN (US)

( * ) Notice: Subject to any disclaimer, the term of this patent is extended or adjusted under 35 U.S.C. 154(b) by 0 days.

(21) Appl. No.: 09/545,538

(22) Filed: Apr. 7, 2000

Related U.S. Application Data

(63) Continuation-in-part of application No. 09/174,110, filed on Oct. 17, 1998, which is a continuation-in-part of application No. 09/057,139, filed on Apr. 8, 1998, which is a continuation-in-part of application No. 08/713,412, filed on Sep. 13, 1996, now Pat. No. 5,890,238, which is a continuation-in-part of application No. 08/527,519, filed on Sep. 13, 1995, now Pat. No. 5,737,781

(60) Provisional application No. 60/084,519, filed on May 7, 1998, provisional application No. 60/092,286, filed on Jul. 10, 1998, and provisional application No. 60/128,144, filed on Apr. 7, 1999.

(51) Int. Cl.[7] ..... A61G 7/10

(52) U.S. Cl. ..... 5/81.1 HS; 5/81.1 R; 5/88.1

(58) Field of Search ..... 5/81.1 HS, 81.1 R, 5/81.1 C, 83.1, 84.1, 86.1, 88.1, 89.1

(56) References Cited

U.S. PATENT DOCUMENTS

| | | | |
|---|---|---|---|
| 378,220 | A | 2/1888 | Staples et al. |
| 716,886 | A | 12/1902 | Goode |
| 1,263,611 | A | 4/1918 | Scroggin |
| 1,815,006 | A | 7/1931 | Horsting et al. |
| 2,093,231 | A | 9/1937 | Broadwell |
| 2,392,083 | A | 1/1946 | Dumbleton |
| 2,439,066 | A | 4/1948 | Vanderlyn et al. |
| 2,487,648 | A | 11/1949 | Green |
| 2,536,707 | A | 1/1951 | Allyn |
| 2,630,583 | A | 3/1953 | Gilleland |
| 2,632,619 | A | 3/1953 | Wilson |
| 2,710,975 | A | 6/1955 | Stoen et al. |
| 2,733,452 | A | 2/1956 | Tanney |
| 2,745,163 | A | 5/1956 | Van Buren |
| 2,761,153 | A | 9/1956 | Mew |
| 2,826,766 | A | 3/1958 | Stoner |
| 2,827,642 | A | 3/1958 | Huff |
| 2,939,195 | A | 6/1960 | Carlson |
| 2,959,792 | A | 11/1960 | Haugard |
| 3,140,069 | A | 7/1964 | McBurney et al. |
| 3,165,760 | A | 1/1965 | Abajian |
| 3,289,685 | A | 12/1966 | Parker |
| 3,294,247 | A | 12/1966 | Norrington |
| 3,302,219 | A | 2/1967 | Harris |
| 3,413,663 | A | 12/1968 | Swann |
| 3,417,765 | A | 12/1968 | Slater et al. |
| 3,593,351 | A | 7/1971 | Dove |
| 3,597,774 | A | 8/1971 | Warren |

(List continued on next page.)

FOREIGN PATENT DOCUMENTS

| | | |
|---|---|---|
| DE | 2257572 | 5/1974 |
| DE | 2308436 | 8/1974 |
| GB | 7869 | of 1895 |

(List continued on next page.)

*Primary Examiner*—Robert G. Santos
(74) *Attorney, Agent, or Firm*—Patterson, Thuente, Skaar & Christensen, P.a.

(57) ABSTRACT

A mobile patient maneuvering device is provided. The maneuvering device cooperates with the transfer rod to move a sheet upon which a patient is disposed. The device includes a power train, a hook and web assembly attachable to the power train, and a power and switching system in electrical communication with the power train. The power and switching system may also include means for stabilizing the device actuated by contact with the support. The displacing device may be positioned between a head portion of a bed and a wall, thereby occupying a minimum of floor space.

38 Claims, 24 Drawing Sheets

U.S. PATENT DOCUMENTS 3,669,133 A 6/1972 Hyman
3,730,544 A 5/1973 Hyman
3,769,642 A 11/1973 Warman
3,775,784 A 12/1973 Fry
3,779,474 A 12/1973 Harelson
3,794,313 A 2/1974 Berger et al.
3,810,263 A 5/1974 Taylor et al.
3,849,813 A 11/1974 Neilson
3,866,619 A 2/1975 Per Frisk
3,924,281 A 12/1975 Gibbs
3,963,037 A 6/1976 Clark
4,038,572 A 7/1977 Hanagan
4,051,565 A 10/1977 Berge
4,068,770 A 1/1978 Boehringer
4,194,253 A 3/1980 Ullven
4,270,234 A 6/1981 James
4,281,564 A 8/1981 Hill
4,327,453 A 5/1982 Sefton
4,403,641 A 9/1983 Reeder
4,416,511 A 11/1983 Weinberg
4,502,169 A 3/1985 Persson
4,520,518 A 6/1985 Reaser
4,631,761 A * 12/1986 Lederman ..... 5/87.1
4,635,308 A 1/1987 Maggion et al.
4,644,595 A 2/1987 Daniel
4,679,259 A 7/1987 DiMatteo et al.
4,680,818 A 7/1987 Ooka et al.
4,681,279 A 7/1987 Nakamura
4,686,748 A 8/1987 Kaivanto
4,688,304 A 8/1987 Marcott
4,696,025 A 9/1987 Taylor
4,726,082 A 2/1988 DiMatteo et al.
4,747,170 A 5/1988 Knouse
4,761,841 A 8/1988 Larsen
4,768,497 A * 9/1988 Winge ..... 601/26
4,776,047 A 10/1988 DiMatteo
4,782,543 A 11/1988 Hutton et al.
4,787,104 A 11/1988 Grantham
4,794,660 A 1/1989 Hawkrigg
4,796,313 A 1/1989 DiMatteo et al.
4,809,377 A 3/1989 Lynn
4,809,725 A 3/1989 Champigny
4,819,283 A 4/1989 DiMatteo et al.
4,821,352 A 4/1989 DiMatteo et al.
4,837,872 A 6/1989 DiMatteo et al.
4,837,873 A 6/1989 DiMatteo et al.
4,850,562 A 7/1989 Mazzanti
4,868,938 A 9/1989 Knouse
4,868,940 A 9/1989 Masadi
4,926,512 A 5/1990 Coyle
4,937,901 A 7/1990 Brennan
4,970,738 A 11/1990 Cole
5,005,232 A 4/1991 Wright et al.
5,014,968 A 5/1991 Lammers et al.
5,016,306 A 5/1991 Grivna et al.
5,022,810 A 6/1991 Sherrow et al.
5,033,132 A 7/1991 Greenblatt
5,033,170 A 7/1991 Ewert
5,036,557 A 8/1991 Fales
5,038,424 A 8/1991 Carter et al.
5,065,464 A 11/1991 Blanchard et al.
5,072,840 A 12/1991 Asakawa et al.
5,127,113 A 7/1992 DiMatteo et al.
5,161,276 A 11/1992 Hutton et al.
5,163,189 A 11/1992 DeGray
5,168,587 A 12/1992 Shutes
5,182,827 A 2/1993 Carrier et al.
5,197,156 A 3/1993 Stryker et al.
5,271,110 A 12/1993 Newman
5,279,010 A 1/1994 Ferrand et al.
5,319,813 A 6/1994 DiMatteo et al.
5,329,655 A 7/1994 Garner
5,331,988 A 7/1994 Harmon
5,340,266 A 8/1994 Hodgetts
5,348,273 A * 9/1994 Sandell et al. ..... 254/385
5,377,391 A 1/1995 Foster
5,379,468 A 1/1995 Cassidy et al.
5,394,576 A 3/1995 Soltani et al.
5,404,602 A 4/1995 Kondo
5,482,070 A 1/1996 Kelly
5,511,255 A 4/1996 Schuerch
5,522,100 A 6/1996 Schilling et al.
5,539,941 A 7/1996 Fuller
5,544,371 A 8/1996 Fuller
5,642,537 A 7/1997 Johnson
5,659,905 A 8/1997 Palmer, Jr. et al.
5,669,089 A 9/1997 Dees
5,694,654 A * 12/1997 Roy ..... 5/83.1
5,697,109 A 12/1997 Hodgetts
5,737,781 A * 4/1998 Votel ..... 5/81.1 HS
5,819,339 A 10/1998 Hodgetts
5,890,238 A * 4/1999 Votel ..... 5/81.1 HS
5,996,144 A * 12/1999 Hodgetts ..... 5/81.1 R
6,289,533 B1 * 9/2001 Hodgetts ..... 5/81.1 R
6,341,393 B1 * 1/2002 Votel ..... 5/81.1 HS
6,378,148 B1 * 4/2002 Votel ..... 5/81.1 HS
6,393,636 B1 * 5/2002 Wheeler ..... 5/81.1 R

FOREIGN PATENT DOCUMENTS

GB 26017 of 1907
GB 10012 of 1909
GB 420697 12/1934
GB 2068850 A 8/1981
WO WO 86/00221 1/1986
WO WO 97/09896 3/1997
WO WO 98/44889 10/1998

* cited by examiner

DEVICE FOR PATIENT PULLUP, ROLLOVER, AND TRANSFER AND METHODS THEREFOR

CROSS-REFERENCES TO RELATED APPLICATIONS

This application is a continuation in part of U.S. application Ser. No. 09/174,110 filed on Oct. 17, 1998, which is a continuation in part of U.S. application Ser. No. 09/057,139 filed on Apr. 8, 1998, which is a continuation in part of U.S. application Ser. No. 08/713,412 filed on Sep. 13, 1996 now U.S. Pat. No. 5,890,238, which is a continuation in part of Application Ser. No. 08/527,519 now Pat. No. 5,737,781 filed on Sep. 13, 1995. This application incorporates by reference the entire contents of the previously mentioned applications and patents and the entire contents of U.S. Provisional Application No. 60/084,519 filed May 7, 1998 and U.S. Provisional Application No. 60/092,286 filed Jul. 10, 1998. Furthermore, this application claims priority to and incorporates by reference the entire contents of U.S. Provisional Application No. 60/128,144 filed Apr. 7, 1999.

BACKGROUND OF THE INVENTION

1. Field of the Invention

This invention relates to systems which assist in moving patients who are on beds, gurneys, or other such patient supports. More particularly, the invention relates to systems which enable a single health care worker to effect a patient pullup, roll the patient to a desired position, or laterally transfer the patient to another patient support.

2. Background of the Invention

Partially or totally incapacitated persons in hospitals, nursing homes, or other assisted care settings must often be routinely and periodically pulled up from a slumped position, rolled over, or transferred between patient supports such as beds and gurneys. These maneuvers are typically done manually by two or more attendants, although the number of attendants required to perform a maneuver increases with the weight of the patient.

It is often desirable for patients to lie on platforms in which the head portion of the platform has been raised or angled upwardly. Often, to obtain the most benefit and comfort from a bed in this raised position, the patient should be disposed such that the patient's abdomen and thorax are in an elevated position. However, totally or partially incapacitated patients tend to slide or slump out of this position toward the foot of the bed, thereby losing the healthful benefits of a more upright position.

Another activity frequently required of caregivers is patient rollover. Patient rollover is necessary for maintaining patient comfort, facilitating examination, and preventing bed sores from forming.

A third activity is transporting the patient between patient supports, such as a bed and a gurney/cart, a cart to an operating or procedural table, etc. Generally speaking, this includes maneuvering the patient to another location.

Typically, space is limited in hospital and assisted care rooms. Therefore, devices to effect patient pullups, rollovers, or transfers must either occupy a minimum of space (if kept in the room) or be transported in and out of the room when required. Activities, such as pullups, are typically performed at frequent intervals and it is usually not feasible to transport equipment to and from a room to perform a patient pullup every two hours. However, if such a device used for pullup is to be stored in one of these rooms, the device must occupy a minimum of the limited space available and should be placed so that the pullup will be efficiently accomplished.

U.S. Pat. No. 2,827,642, issued to Huff on Mar. 25, 1958, discloses a device for moving a patient on a bed. The device includes a shaft mounted in ball bearing brackets. The brackets are bolted or otherwise secured to the headposts of the bed. Straps for a fabric webbing are secured to the shaft and a fabric supporting section is secured to the straps. A crank handle is removably secured to one end of the shaft. A patient lying on the fabric supporting section is pulled toward the head of the bed by cranking, and thereby winding the straps on, the shaft.

U.S. Pat. No. 5,608,929, issued to Crane on Mar. 11, 1997, discloses a patient-positioning device. The positioning device includes a sheet which is placed under the patient and connected to a rope or braided line. One end of the braided line is anchored to a metal peg on the headboard. The remainder of the braided line is threaded through several pulleys. One of the pulleys is attached to a frame assembly. The patient is pulled up when the head portion of the bed is raised or by an independent motor operating to wind the line. The patient-positioning device of Crane, appears to require extensive retrofitting of beds and is not apparently transportable or suitable for various maneuvers.

U.S. Pat. No. 3,597,774, issued to Warren on Aug. 10, 1971, discloses a patient moving device which is attached to hospital beds. The patient moving device includes an adjustable post and clamps for attaching the post to the head of a bed. A winch is mounted on the post. A patient to be pulled up is secured with apron straps and apron tabs are connected to a T-bar. The T-bar is connected to a cable. The winch is operated to wind the cable and pull the patient up. Alternatively, a harness is employed. The harness is arranged under the patient's arm pits and connected to the T-bar before the winch is operated to pull the patient up.

U.S. Pat. No. 3,302,219, issued to Harris on Feb. 7, 1967, discloses a hospital bed and lifting and turning device. The lifting and turning device includes four vertical support members adjacent the head and foot of the bed. The vertical support members are hollow and threaded to receive the lower end of threaded members extending vertically from the vertical support members. The vertical support members are interconnected by side braces and transverse braces. A sprocket member is disposed atop each vertical member. Each sprocket member is adapted to threadably engage, and thereby raise or lower, a threaded member within the vertical support member. The drive sprockets are interconnected by an endless sprocket chain. An electric motor may be secured to one of the vertical members to drive the sprockets. Upper ends of the threaded members are provided with clamp members. Two elongated rods extend through outwardly extending portions of the clamp members. A sprocket wheel is secured to each elongated rod and separate sprocket drive chains connect sprocket wheel pairs at head and foot portions of the device. A fabric such as canvas is secured to the rods and rolled thereon. The fabric is rolled such that it will be wound on one rod and unwound from the other when the sprocket wheels are rotated. The hospital bed lifting and turning device of Harris appears to require extensive set up, is not readily transportable, and cannot effect a patient pullup or lateral transfer.

U.S. Pat. No. 5,544,371, issued to Fuller on Aug. 13, 1996, discloses a bed patient turning, lifting and transporting apparatus with a mobile, folding and knock-down frame. The apparatus does appear to be conveniently mobile and requires extensive set up before being used. The apparatus of Fuller also requires significant overhead space and could interfere or impede other necessary activities performed by medical personnel in attendance.

U.S. Pat. No. 5,659,905, issued to Palmer et al. on Aug. 26, 1997, discloses a patient transfer/turning bed. The patient transfer/turning bed of Palmer et al. includes powered rotating drive rollers on each side of the bed's mattress. The drive rollers are connected to articulating arms which pivot about an axis near the center of the head end and the foot end of the bed. A transfer/turning sheet removably connects the drive rollers. By raising the drive roller on one side of the bed, a patient will be rolled over toward the opposite side. The patient may also be transferred laterally across the bed by turning the drive rollers. In addition to requiring extensive bed retrofit, the patient transfer/turning bed of Palmer et al., is not readily transportable and cannot effect a patient pullup.

U.S. Pat. No. 2,665,432 issued to Butler on Jan. 12, 1954, discloses a patient transferring device. The patient transferring device of Butler is disclosed as including a roller mounted to a gurney. A pull unit is attached to the roller by a series of hooks and attaches to a transfer sheet. Although capable of effecting a type of lateral patient transfer, the patient transferring device of Butler cannot effect either a patient pullup or patient rollover.

U.S. Pat. No. 2,733,452, issued to Tanney on Feb. 7, 1956, discloses a hospital patient transfer device. The patient transfer device of Tanney is adapted to be mounted on a wheeled stretcher so that a patient may be transferred from a hospital bed to the stretcher or from the stretcher to the bed. The patient transfer device includes one roller mounted on the bed and another roller mounted on the stretcher. A cable is wound on one of the rollers and tracks thereby pulling a sheet from the stretcher while the sheet is guided beneath a patient disposed on the bed. After the patient and sheet are positioned, the sheet is wound on the roller mounted on the stretcher, thereby transferring the patient. The hospital patient transfer device of Tanney appears to require extensive bed and stretcher retrofit and cannot function either to pull a patient up or effect a patient rollover.

U.S. Pat. No. 4,776,047 issued to DiMatteo on Oct. 11, 1988, discloses a multiple function invalid bed arrangement for transferring a prone patient longitudinally or laterally between beds or surfaces adapted to accept the patient in a prone position. The longitudinal bed transfer is accomplished by equipping the patient's bed with two rollers, one roller at the head and one roller at the foot of the bed. A bed sheet is connected from the head to the foot roller much like a piano roll. The rollers are rotated to transfer the patient to a second bed which is equipped similarly. Thus, the multiple function invalid bed arrangement of DiMatteo appears to require extensive bed retrofit and cannot effect patient maneuvering without such retrofitting.

U.S. Pat. No. 4,868,938 issued to Knouse on Sep. 16, 1989, discloses a transportable patient mover and moving method. The patient mover moves a patient laterally from a first to a second surface such as from a bed to a gurney. The patient mover includes a bottom stand member and an upstanding support frame carrying an elongated roller. The support frame may be mounted on wheels or casters. One edge of a web-like sheet material is attached to the roller. The other edge of the web material is attached to a clamp. A transfer sheet disposed beneath a patient is secured by the clamp and the roller winds the web thereon, thereby transferring the sheet and patient thereon. The patient mover of Knouse does not appear suitable for remaining in a small hospital room between uses without interfering with essential activities.

There is a need for a device which can enable a single attendant to effect patient pullups, rollovers, and lateral transfers, which is readily transportable, and which may be conveniently stored in a patient's room between uses.

SUMMARY OF THE INVENTION

This invention meets the needs of the industry by providing a device for maneuvering a patient who is located on a support platform. The support platform may be configurable to a generally horizontal position or otherwise. A pliable underlayment may be disposed proximate the patient and the support. The device may be operable by a single person or operator and may include a power train, a hook and web assembly, and a power and switching system.

The hook and web assembly may be windably attachable to the power train. The power and switching system may be in electrical communication with the power train and may include means for stabilizing the device. The stabilizing means may be actuated by contacting a first member of the support and may be in electrical communication with the power and switching system. The stabilizing means may include at least one extension accommodating a first switch activating the power and switching system. The stabilizing means may include a locking mechanism accommodated by the support. The hook and web assembly may include at least one belt and at least one hook. Each belt may be attachable to the power train and to one of the hooks. The device may further include a first base member and an optional second base member. The second base member may be locked into an extended position to further stabilize the device.

This invention also provides a method of displacing a patient. The method includes providing a device with a power train, a hook and web assembly, and a power and switching system. The hook and web assembly may be attachable to the power train. The power and switch system may be in electrical communication with the power train. The power and switching system may include means for stabilizing the device. The stabilizing means may be actuated by contact with a first member of the support and may be in electrical communication with the power and switching system. The method includes securing a pliable underlayment proximate the patient to the hook and web assembly. The method further includes stabilizing the device by contacting a first member of the support to the stabilizing means and actuating the power train.

DETAILED DESCRIPTION OF THE DRAWINGS

Comprehension of this invention can be gained through reference to the drawings in conjunction with a thorough review of the following explanation. In order to facilitate a full appreciation of the invention, an overview of an exemplary embodiment is initially provided. The overview is followed by more detailed explanation.

The device of this invention is capable of ergonomically effecting patient displacement events such as pullups, lateral transfers, and rollovers by a single attendant. The device of this invention is mobile and fully transportable by a single attendant to and from the sites at which patient displacement events will occur. The device of this invention is conveniently and feasibly disposable between a patient support, such as a bed or a gurney, and a wall or other adjoining structure. The device of this invention is contemplated to be used to effect patient desplacement events on supports which may be conformable to a generally horizontal position, although displacement events may be effected on supports without this capability as well. Displacing devices of the present invention can be used to effect patient pullup events on supports in which the head portion thereof is in an elevated position, such as about 10 degrees from the horizontal.

Another embodiment of the invention incorporates the patient transfer device into the headboard, footboard or other portions of a patient support, such as the bed, gurney, cart, table or like patient supports. Therefore, making the patient transfer device a permanent component of the patient support. Furthermore, in another embodiment the patient transfer device may be connected or affixed to the headboard, footboard or other portions of the bed by connection means, such as clamps or other fasteners.

Figure 1:
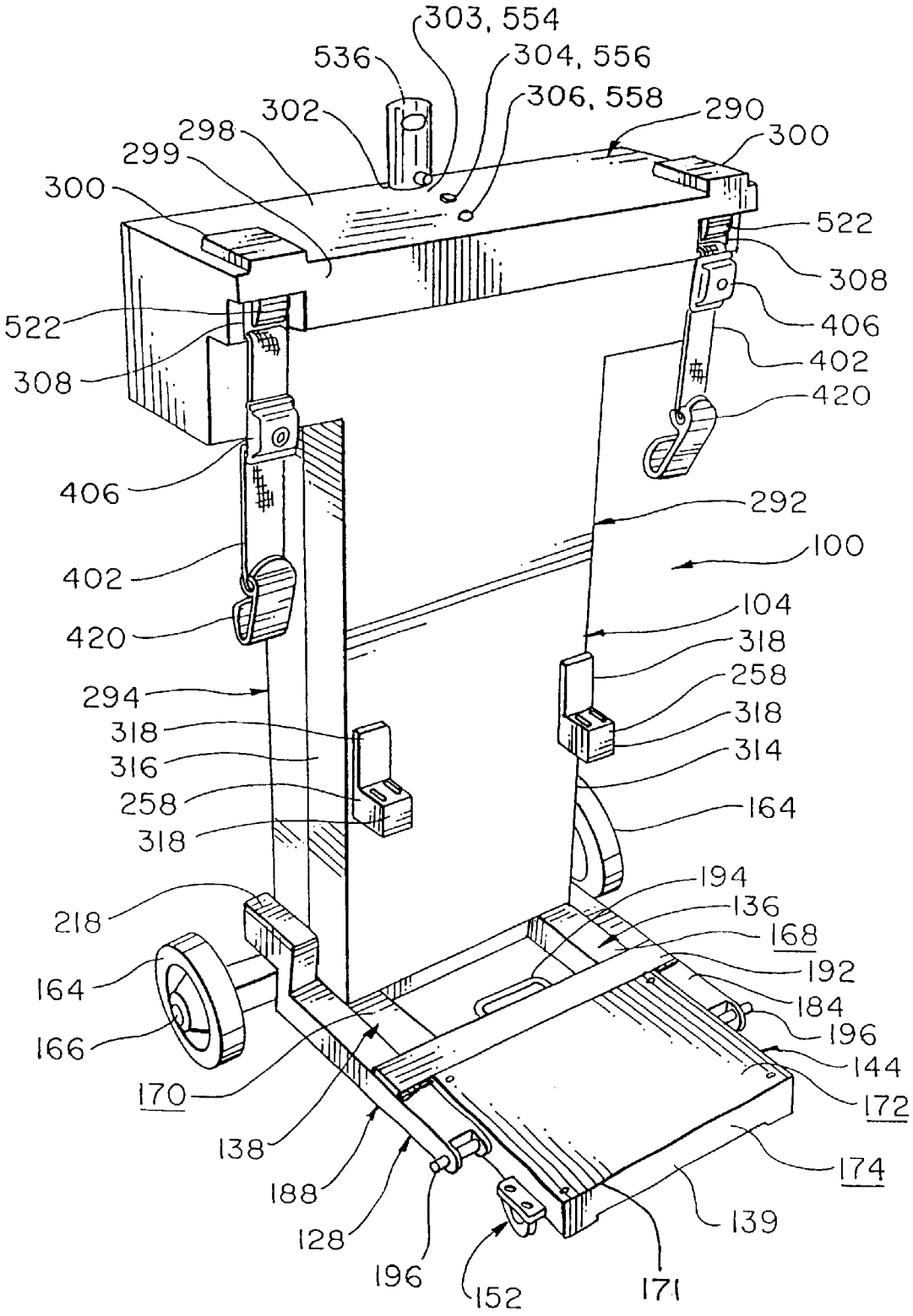
FIG. 1 is a front perspective view of a patient maneuvering device of this invention.
Figure 1A:
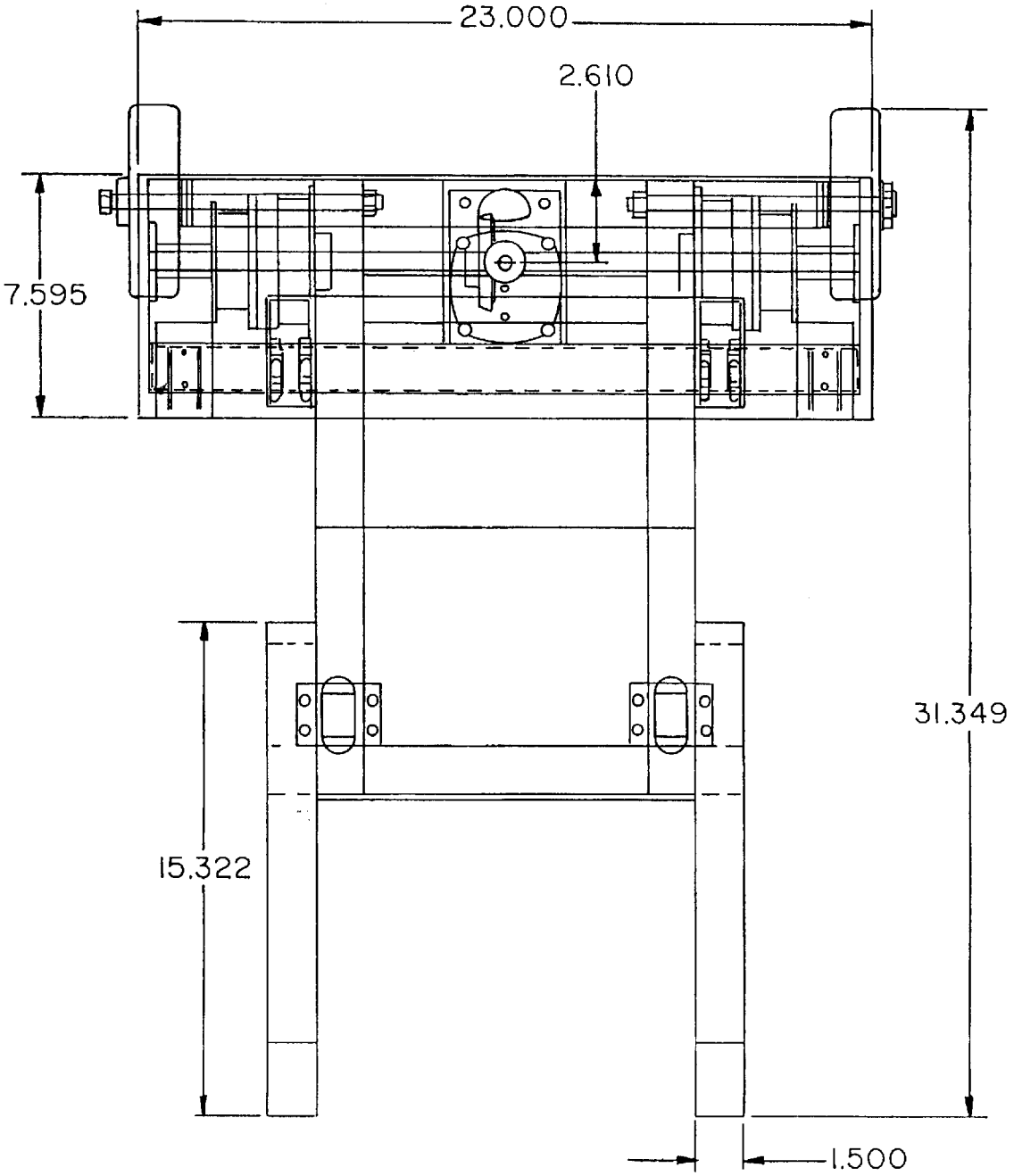
FIG. 1*a* is a top view of a patient maneuvering device of this invention.
Figure 1B:
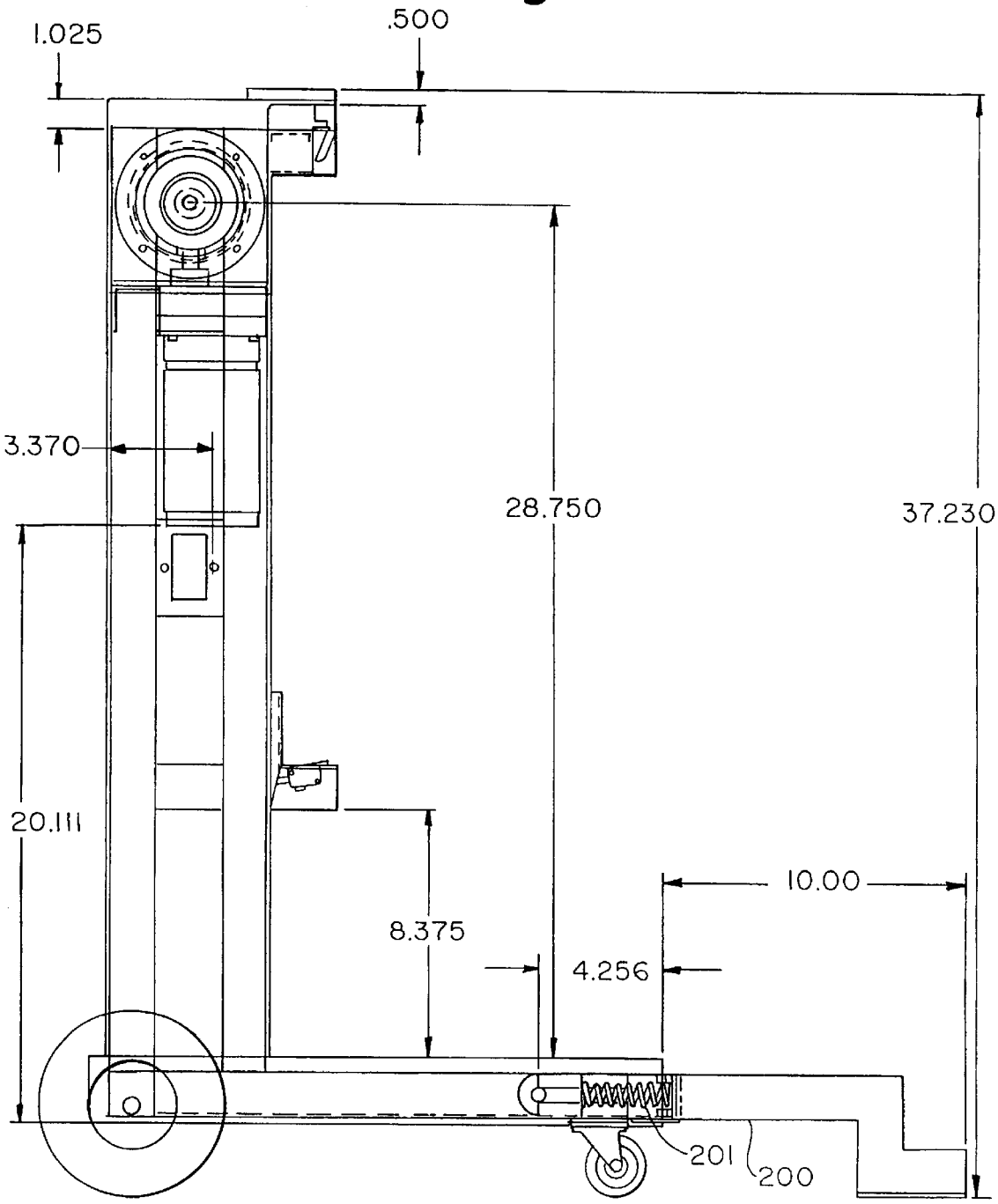
FIG. 1*b* is a side view of a patient maneuvering device of this invention.
Figure 1C:
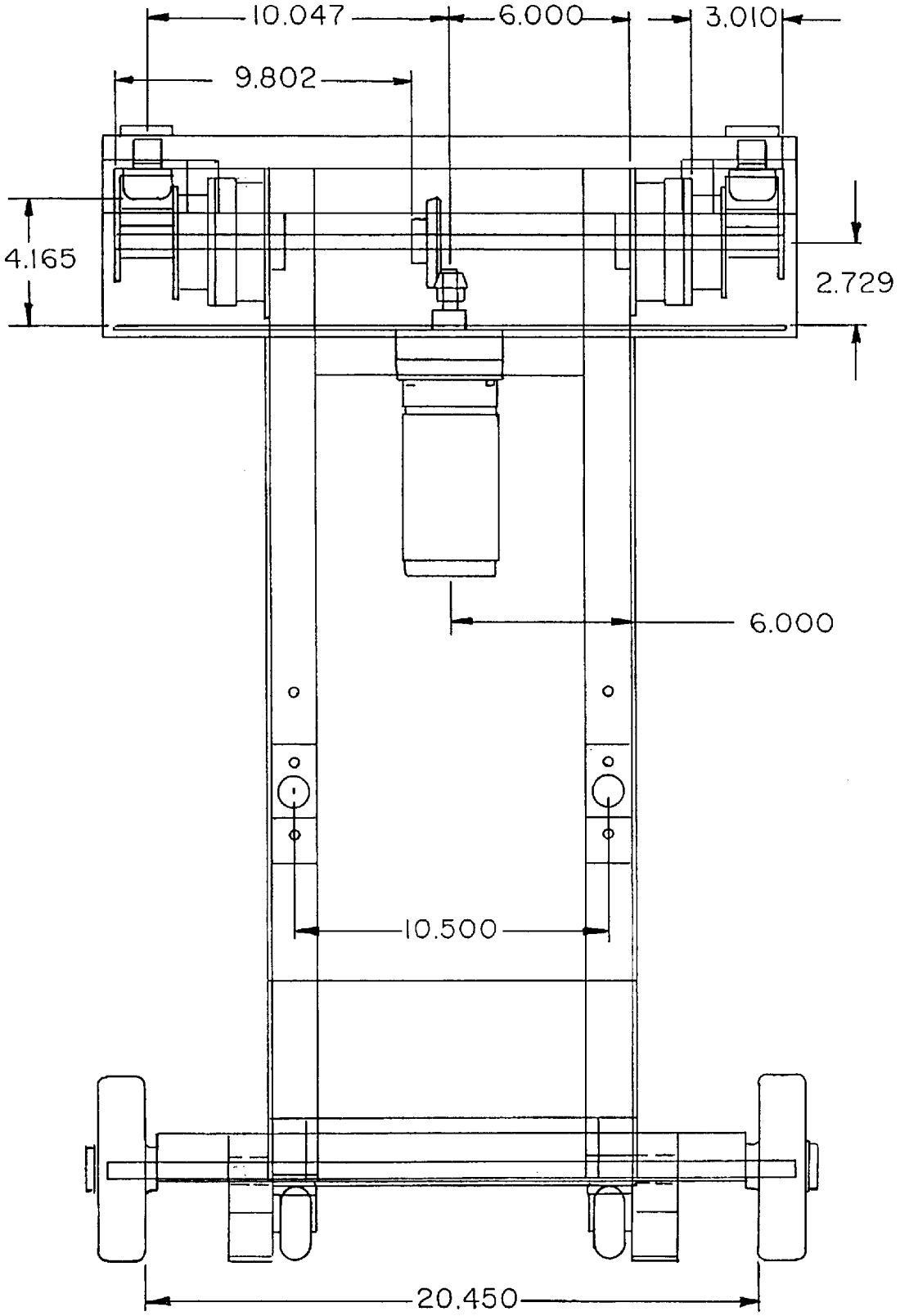
FIG. 1*c* is a back view of a patient maneuvering device of this invention.

The device of this invention, when disposed between a bed and a wall, is designed and dimensioned so as to occupy a minimum of space, thereby minimizing floor space occupied by the bed and the patient displacement device. FIGS. 1*a*–1*c* depict the top, side and back views of one embodiment of the device. This invention is considered to include embodiments disclosed in U.S. Provisional Application No. 60/084,519 and U.S. Provisional Application No. 60/092,286. This invention is further contemplated to include embodiments in U.S. Pat. No. 5,737,781, issued Apr. 14, 1998, U.S. patent application Ser. No. 09/057,139, filed Apr. 8, 1998, and in U.S. patent application Ser. No. 09/174,110, filed Oct. 17, 1998, the entire contents of each hereby incorporated by reference.

Referring to FIGS. 1–4, an exemplary patient displacing device of this invention is depicted generally at 100. Patient displacing device 100 includes frame 102, shield assembly 104, power train 106, hook and web assembly 108, and power and switching system 110.

Frame 102 includes base 112, middle portion 114, and upper portion 116. Base 112 includes first base assembly 124 and may optionally include second base assembly 128. First base assembly 124 includes left base frame member 136, rear base frame member 137, right base frame member 138, front base frame member 139, rear axle and wheel assembly 140, rear plate 142, front plate 144, and a plurality of front wheel assemblies, such as casters 152. Rear axle and wheel assembly 140 includes left axle frame member 156, right axle frame member 160, a plurality of axles (not shown), wheel and bearing assemblies 164, and fasteners 166. Means for transporting embodiments of this invention are contemplated to include rear axle and wheel assembly 140 and casters 152 as well as other suitable embodiments. Left and right base frame members 136 and 138 extend forward from left and right axle frame members 156 and 160. Respective left and right base frame members 136 and 138 display upper surfaces 168 and 170. Front plate 144 may be affixed to an upper surface 171 of front base frame member 139 and to respective upper surfaces 168 and 170 of left and right base frame members 136 and 138. Front plate 144 thereby spans left and right base frame members 136 and 138 in this embodiment.

Respective left and right axle frame members 156 and 160 each house an axle (not shown). Wheel and bearing assemblies 164 are mounted on each axle proximate outboard surfaces of respective left and right axle frame members 156 and 160. Each wheel and bearing assembly 164 includes wheel 176. Each exemplary wheel 176 displays a rear tangent 178, which is generally parallel to longitudinal axis 180 of patient displacing device 100. Tangent 178 represents the point at which device 100 contacts a vertical structure such as a wall when device 100 is disposed between a bed and the wall. In this embodiment, each wheel 176 has an outer diameter of about six inches. While several sizes may be suitable, casters 152 are about 2.4 (2.375) inches in diameter. Locking (breaking) mechanisms may be optionally present in each caster 152. Several suitable embodiments of these locking mechanisms are known to the art.

Referring to FIGS. 1–2, and 5–8, and further referring to the orientation of second base assembly 128 when in an extended position (described below), exemplary optional second base assembly 128 may include left and right frame members 184 and 188, spanning member 192, handle 194, and pivot assembly 196. Respective left and right frame members 184 and 188 include first elements 198 and 200, second elements 202 and 204, and third elements 206 and 208. In this embodiment, first elements 198 and 200, second elements 202 and 204, and third elements 206 and 208 are affixed in a stair-step fashion, with respective first elements 198 and 200 extending generally parallel to, and outboard from, respective left and right base frame members 136 and 138. Respective third elements 206 and 208 extend from second elements 202 and 204 such that third elements 206 and 208 contact the floor (or other surface) upon which patient displacing device 100 is disposed when second base assembly 128 is in an extended position. Respective second elements 202 and 204 display front surfaces 210 and 212 and respective third elements 206 and 208 display upper surfaces 214 and 216. Gripping material 218, such as polyurethane or the like, may be affixed to lower and front surfaces of third elements 206 and 208.

Figure 2:
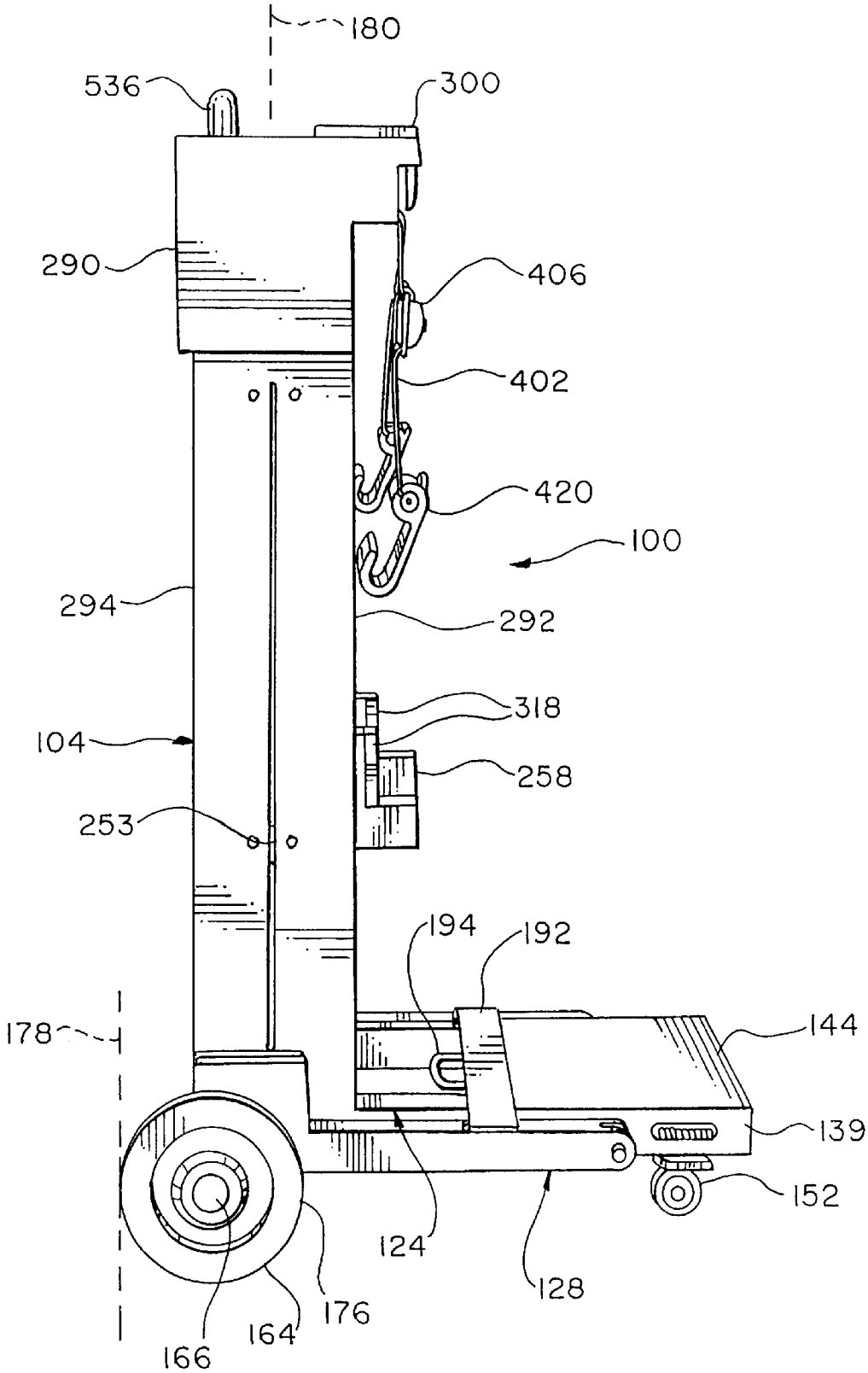
FIG. 2 is a side view of the embodiment of FIG. 1.
Figure 3:
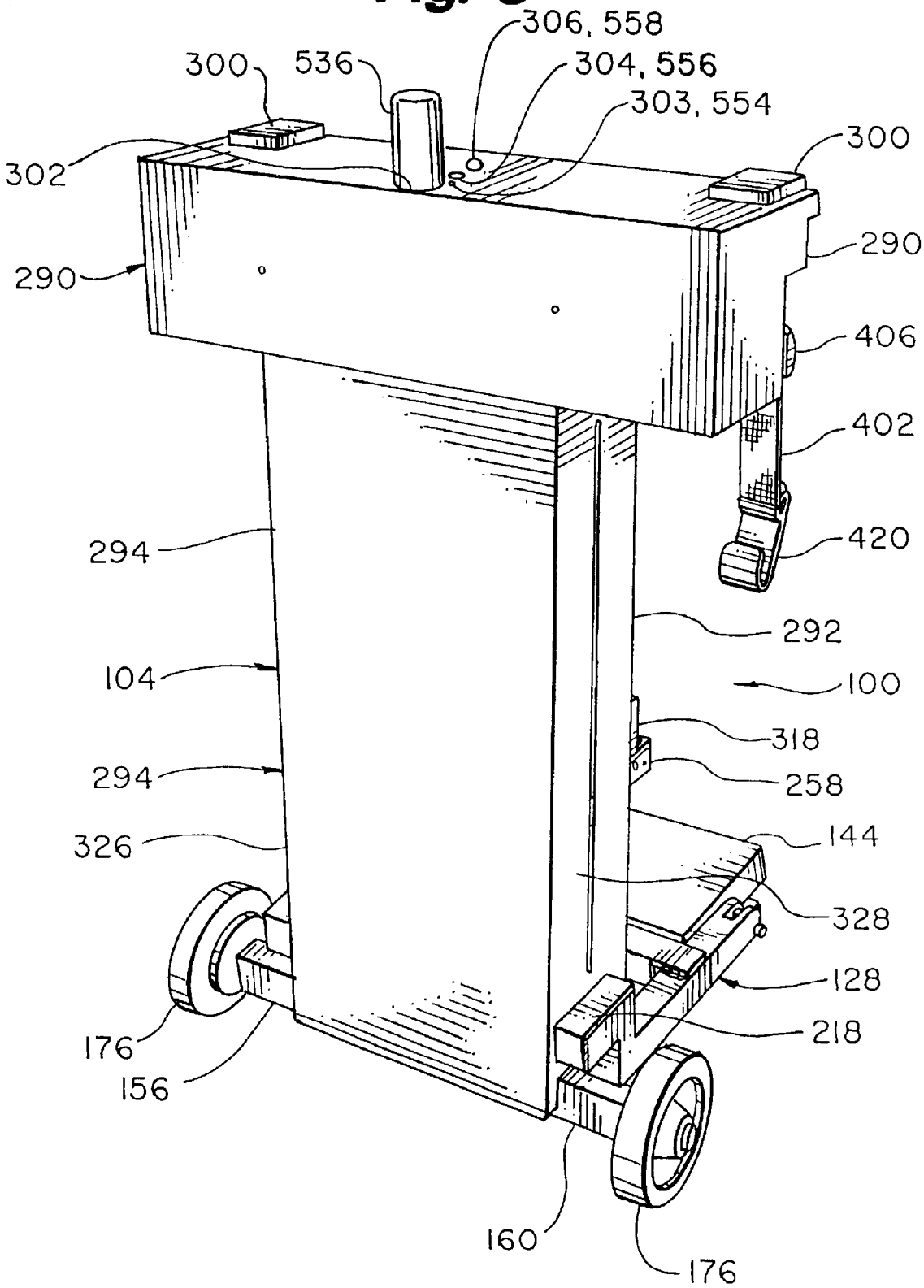
FIG. 3 is a rear perspective view of the embodiment of FIG. 1.
Figure 5:
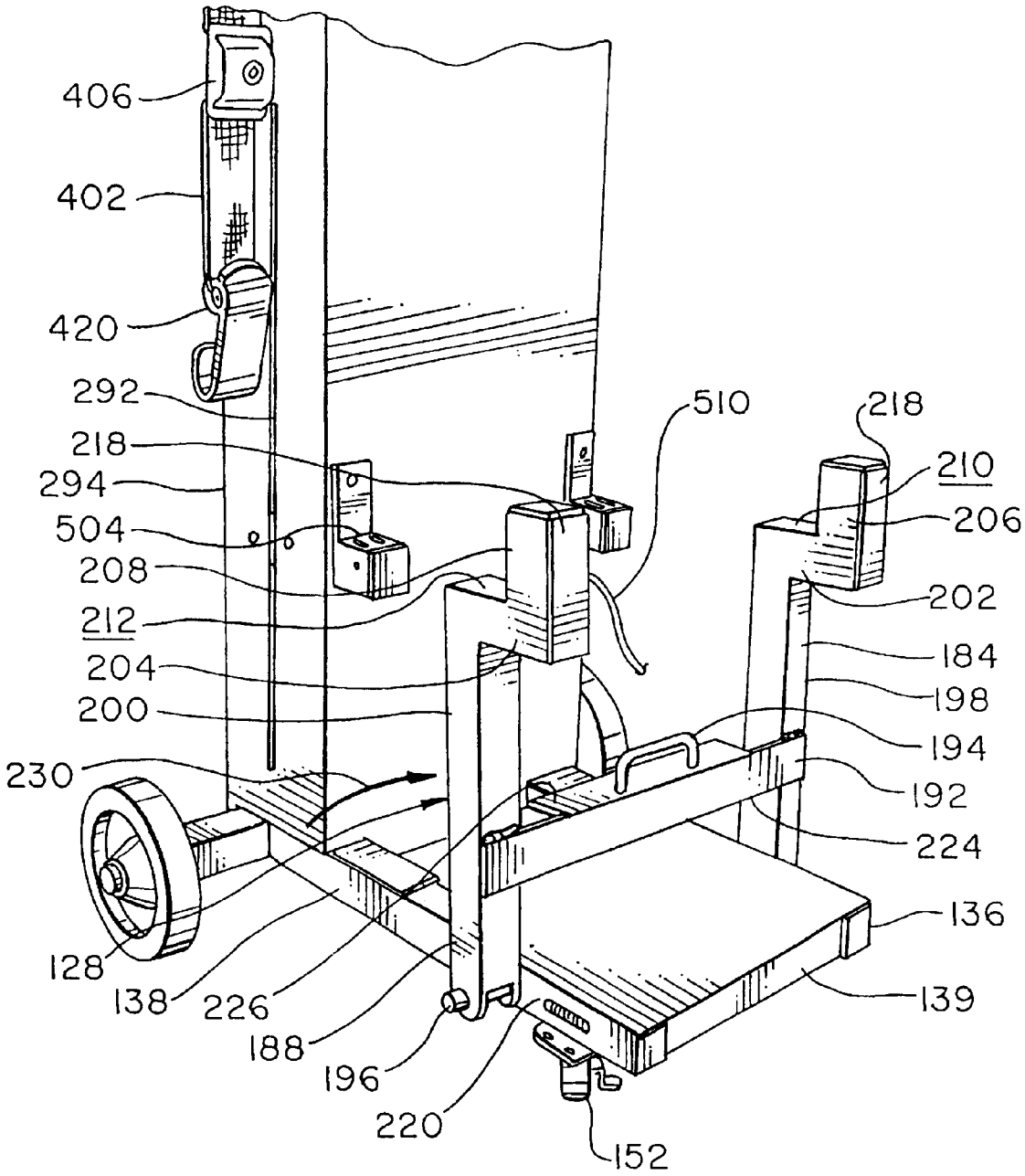
FIG. 5 is a perspective view of a lower portion of the embodiment of FIG. 1 with the second base assembly pivoted toward an extended position.
Figure 6:
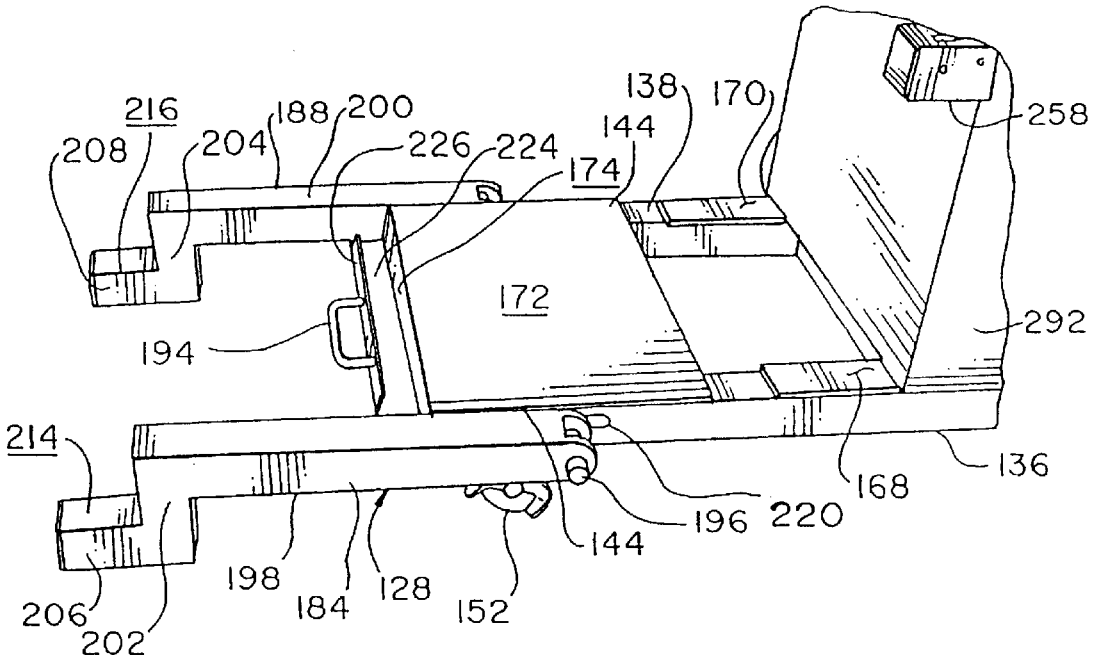
FIG. 6 is a fragmentary perspective view of the embodiment of FIG. 1 with the second base assembly pivoted into an extended position.
Figure 7:
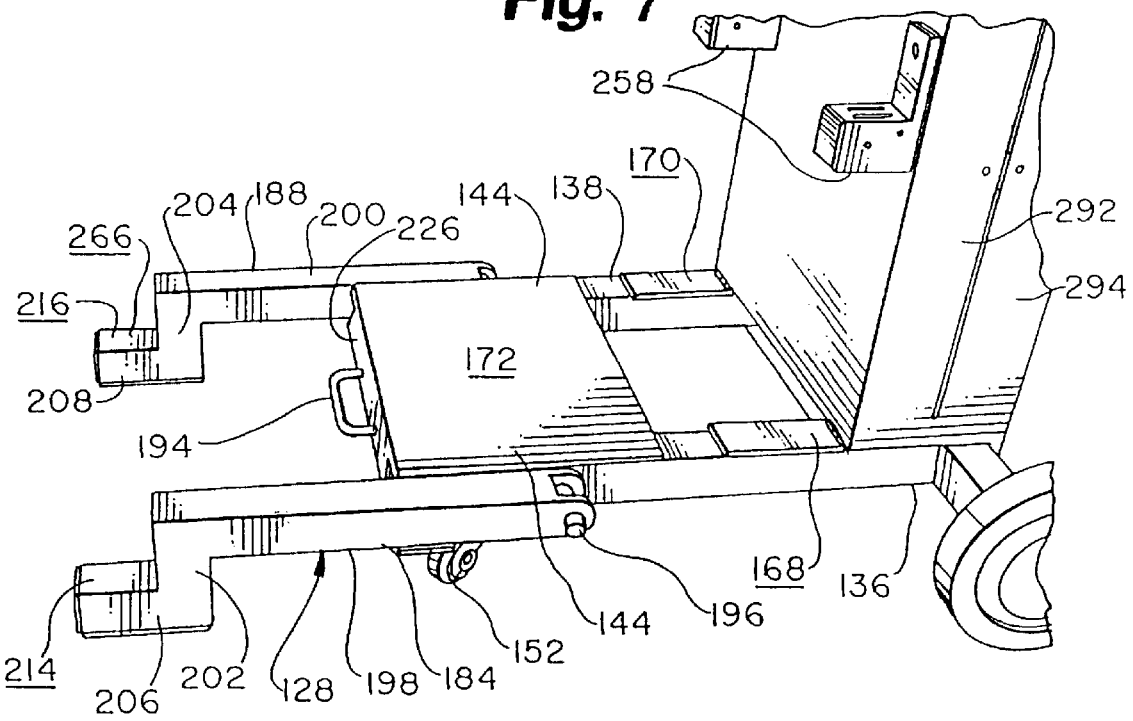
FIG. 7 is a fragmentary perspective view of the embodiment of FIG. 1 with the second base assembly locked into an extended position.
Figure 8:
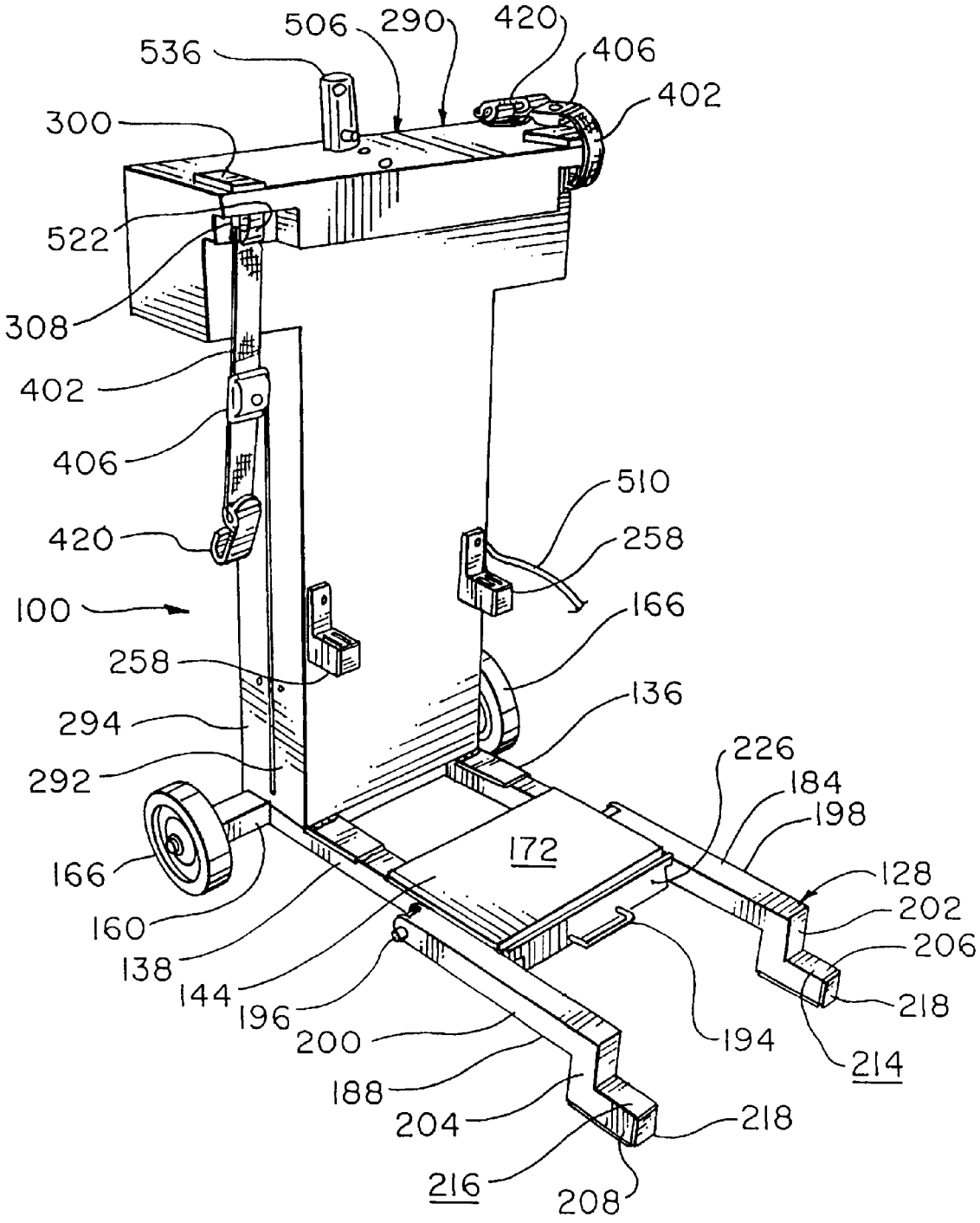
FIG. 8 is another perspective view of the embodiment of FIG. 1 with the second base assembly locked in an extended position.

Spanning member 192 may include respective first and second elements 224 and 226. In this embodiment, first element 224 spans between lower surfaces of elements 198 and 200. Element 226 extends generally perpendicularly (or otherwise transversely) from a forward edge of first element 224. Handle 194 may be affixed to a front surface of second element 226. Exemplary pivot assembly 196 includes such fasteners as bolt-nut combinations and the like and also includes slots 220 defined in front portions of elements 136 and 138. These fasteners extend through rear portions of first elements 198 and 200 and slots 220. When thusly deployed, pivot assembly 196 enables second base assembly 128 to pivot between extended and folded positions as discussed below. Each pivot assembly 196 may further include biasing means such as a spring (not shown). Fasteners extending through first elements 198 and 200 may be biased toward a rear portion of slots 220 by the biasing means. FIGS. 1–3 depict second base assembly 128 in a folded position. FIG. 5 depicts second base assembly 128 being pivoted in the direction of arrow 230. FIG. 6 depicts second base assembly 128 positioned such that pivot assembly 196 has been displaced forward in each slot 220 and first element 224 is in position to be slid under a lower surface of front base frame member 139. FIGS. 7 and 8 depict second base assembly 128 locked in an extended position with first element 224 disposed below a lower surface of front plate 144 and each pivot assembly 196 displaced and biased toward a rear portion of each slot 220 by the biasing means. Thusly locked into an extended position, second base assembly 128 provides added stability to patient displacing device 100. FIG. 1*b* depicts another embodiment of the invention in which first element 200 and first element 198 (not shown) has an extendable means to create a larger base and therefore more support. A further embodiment of the present invention may include a spring 201 which is connected to the first element 200 for easier extension (the opposite first element 198, which is not shown in FIG. 1*b* may also include this feature). Other embodiments of patient displacing device 100 may include further stabilizing means such as weights disposed on or about first base assembly 124. This invention is also contemplated to include stabilizing means such as docking mechanisms disclosed in U.S. Provisional Application No. 60/084,519, U.S. Provisional Application No. 60/092,286, and above-referenced U.S. Pat. No. 5,737,781, U.S. patent application Ser. No. 09/057,139 and U.S. patent application Ser. No. 09/174,110. In an embodiment of the present invention, the docking mechanisms may include height adjustments. Also, the present invention may include docking switches which function to prevent the device from operating until the switches are engaged by the bed or gurney.

Figure 4:
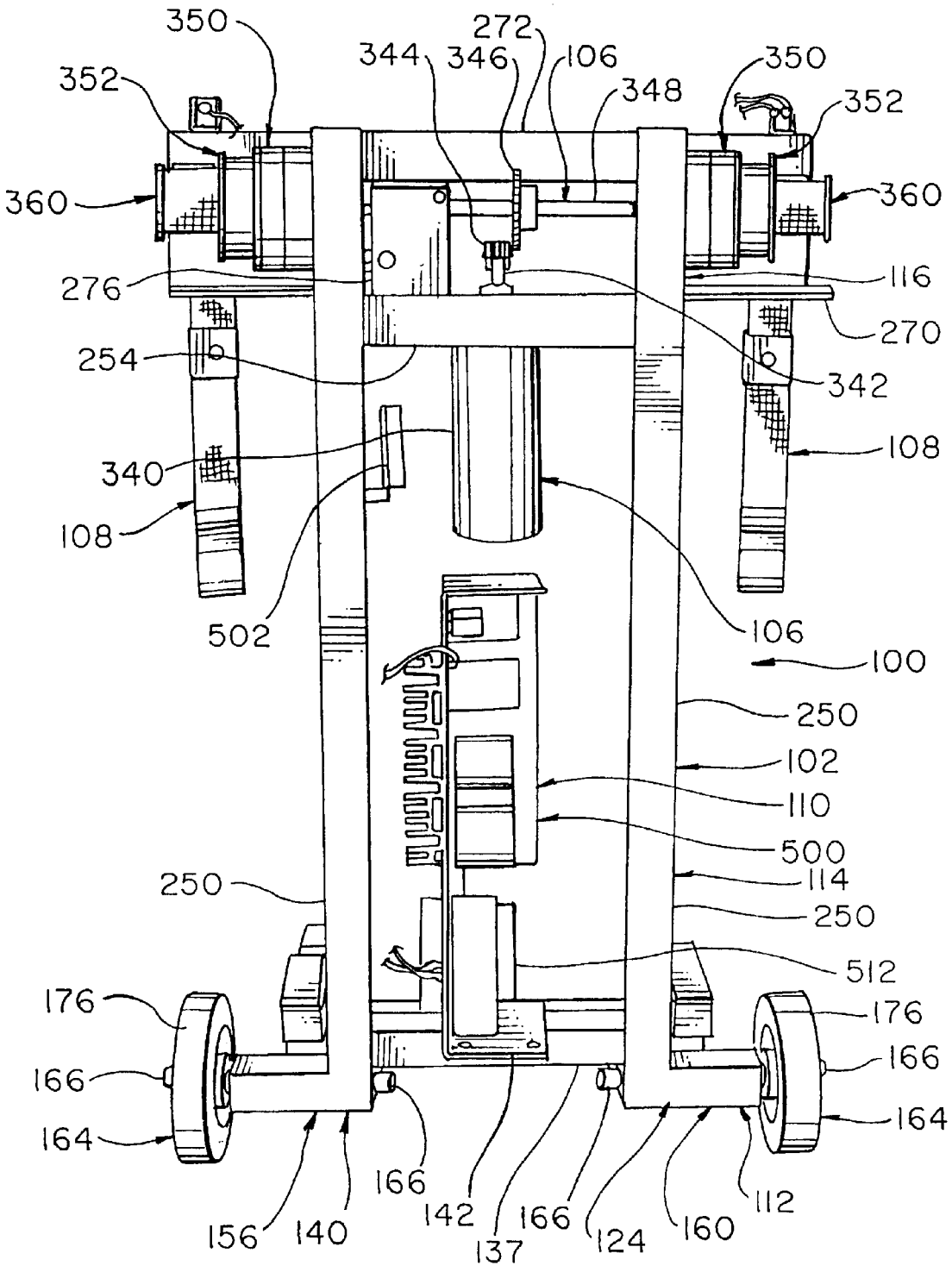
FIG. 4 is a rear view of the embodiment of FIG. 1 with the rear shield removed.
Figure 9:
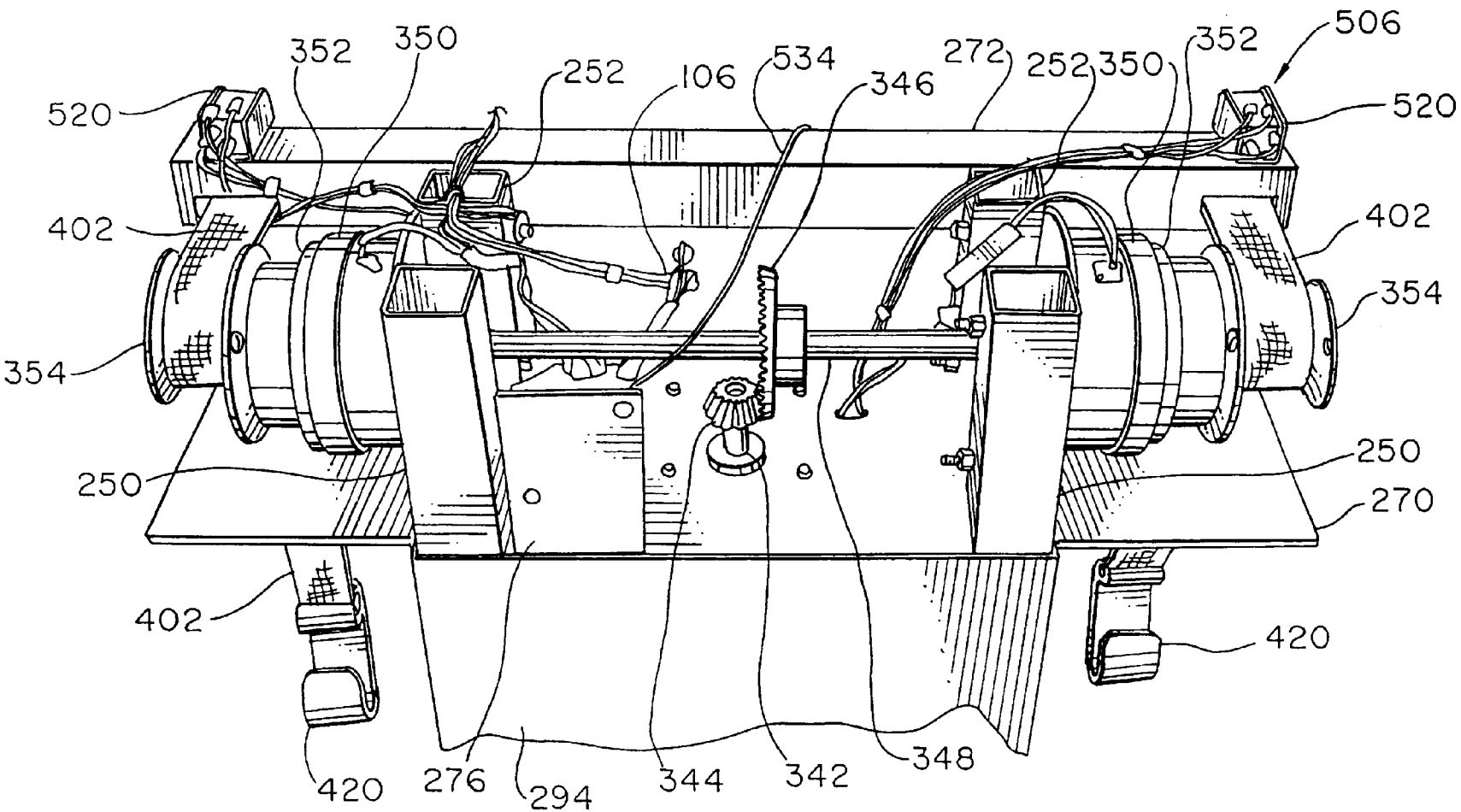
FIG. 9 is a view of part of the embodiment of FIG. 1 with the upper shield removed.

Referring to FIGS. 2, 4 and 9, middle portion 114 of frame 102 includes left and right rear veritcal elements 250, left and right front vertical elements 252, braces 253, rear horizontal element 254, and a plurality of side horizontal elements (not shown). Rear vertical elements 250 extend gereally vertically (or otherwise transversely) from the junctions of respective left and right base frame members 136 and 138 and left and right axle frame members 156 and 160. Front vertical elements 252 extend generally vertically from left and right base frame members 136 and 138. Braces 253 extend between paired front and rear vertical elements 250 and 252. Rear horizontal element 254 extends between left and right vertical elements 250. The side horizontal elements extend between paired rear and front vertical elements 250 and 252.

Referring to FIGS. 1–3, 5–8, and 10, middle portion 114 of frame 102 may further include a plurality of extensions, such as stabilizer brackets 258. Each stabilizer bracket 258 defines upper surface 260, a plurality of slots 262 and is affixed proximate a front edge of each front vertical element 252. In one embodiment, stabilizer brackets 258 are affixed by fasteners which extend through a front shield (described below) and front vertical elements 252. While stabilizer brackets 258 are stationary in this embodiment, other embodiments with vertically adjustable stabilizer brackets are contemplated to be within the scope of this invention.

Upper portion 116 of frame 102 is depicted in FIGS. 4, 9, and 11–12 and includes extensions of respective rear and front vertical elements 250 and 252, plate 270, front horizontal element 272, and remote cord take-up bracket 276. Plate 270 rests on upper surfaces of rear horizontal element 254 and the side horizontal elements. Remote cord take-up bracket 276 extends from, and may be affixed to, a rear portion of plate 270. With the exception of rear horizontal element 254 and spanning member 192, frame members are made from 1½ inch, 14 gauge tube steel in one embodiment. However, several suitable materials are known to the art. Rear horizontal element 254 and spanning member 192 may include angled steel members.

Shield assembly 104 may be seen in FIGS. 1–3, 5, and 8 and broadly includes upper shield 290 and respective front and rear shields 292 and 294. Upper shield 290, in turn, includes upper portion 298, front portion 299, side portions and a rear portion. A plurality of laterally disposed upper extensions 300 extend from upper portion 298. Upper portion 298 defines remote cavity 302, power switch cavity 303, power LED cavity 304, and sensor on/off LED cavity 306. A pair of web openings 308 are defined in front portion 299. A web opening 308 is disposed below each upper extension 300 in this embodiment.

This embodiment of front shield 292 further includes middle portion 314 flanked by lateral portions 316. Bumpers 318 may be present on the surface of front shield 292 and/or on forward surfaces of each bracket 258. Exemplary rear shield includes middle portion 326 disposed between lateral portions 328. Lateral portions 316 and 328 extend generally perpendicularly from respective middle portions 314 and 326 in front and rear shields 292 and 294. Front and rear shields 292 and 294 may be affixed to frame 102 by means of fasteners such as screws extending therethrough and into vertical elements 250 and 252 or braces 253.

Exemplary power train 106 may be viewed in FIGS. 4, 9, and 11–12 and includes motor 340, motor shaft 342, first bevel gear 344, second bevel gear 346, axle shaft 348, a plurality of magnetic clutch assemblies 350, a plurality of slip plates 352, and a plurality of drum assemblies 354. Motor 340 is mounted generally vertically proximate a lower surface of plate 270 by means of fasteners such as machine screws or bolts. Motor shaft 342 extends from motor 340 through plate 270. Respective first and second bevel gears 344 and 346 are affixed to motor shaft 342 and axle 348. Suitable exemplary magnetic clutch assemblies 350, motor 340, slip plate assemblies 352, and drum assemblies 354 are depicted and cooperate with axle 348 in a manner substantially similar to that depicted and described in above-referenced U.S. patent application Ser. No. 09/057,139 and U.S. patent application Ser. No. 09/174,110.

Exemplary motor 340 is a permanent magnet, parallel shaft, DC brush gear motor, operating at 12 volts DC and generating approximately ⅛ hp. In this embodiment, motor 340 rotates motor shaft 342 at an output speed of between about 25 rpm and 75 rpm and attains an output torque range of between approximately 300 in-lbs at 25 rpm and 100 in-lbs at 75 rpm. An exemplary motor may be obtained from Byson Gear and Engineering Corporation, Downers Grove, Ill.

Figure 13:
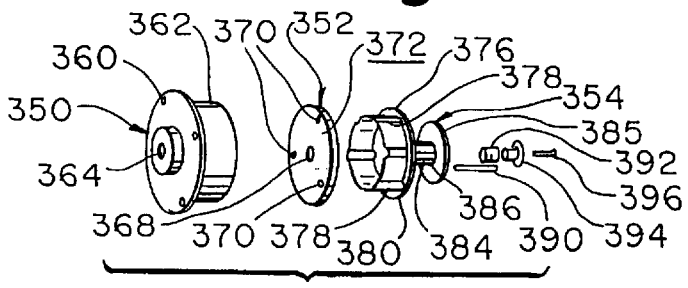
FIG. 13 is an exploded view of one embodiment of a magnetic clutch assembly, slip plate, and drum assembly present in the embodiment of FIG. 1.
Figure 14:
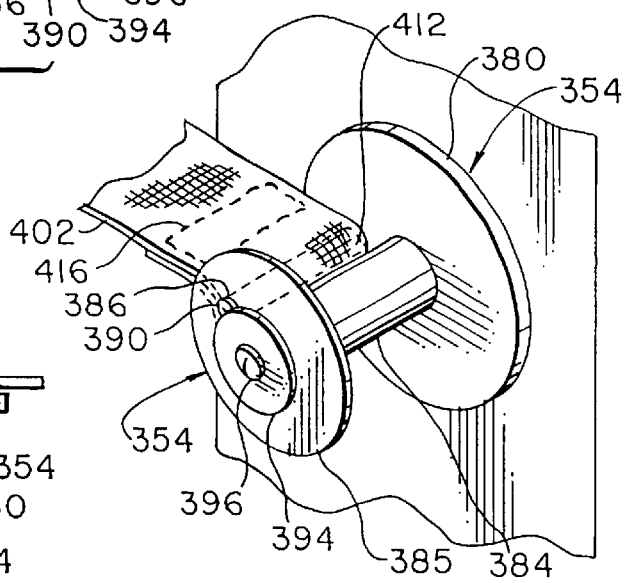
FIG. 14 is a perspective view of a web attached to the drum assembly of the embodiment of FIG. 1.
Figure 16:
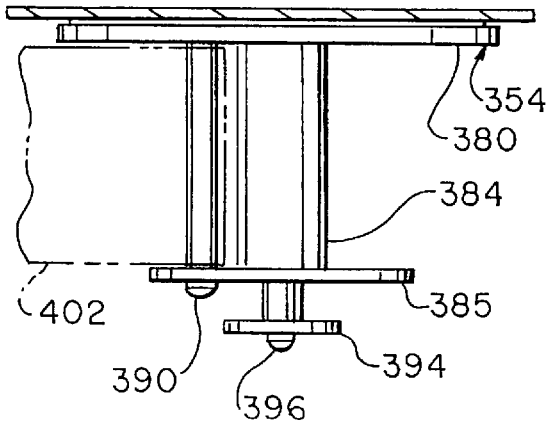
FIG. 16 is a plan view of the web and drum assembly of FIG. 14.
Figure 15:
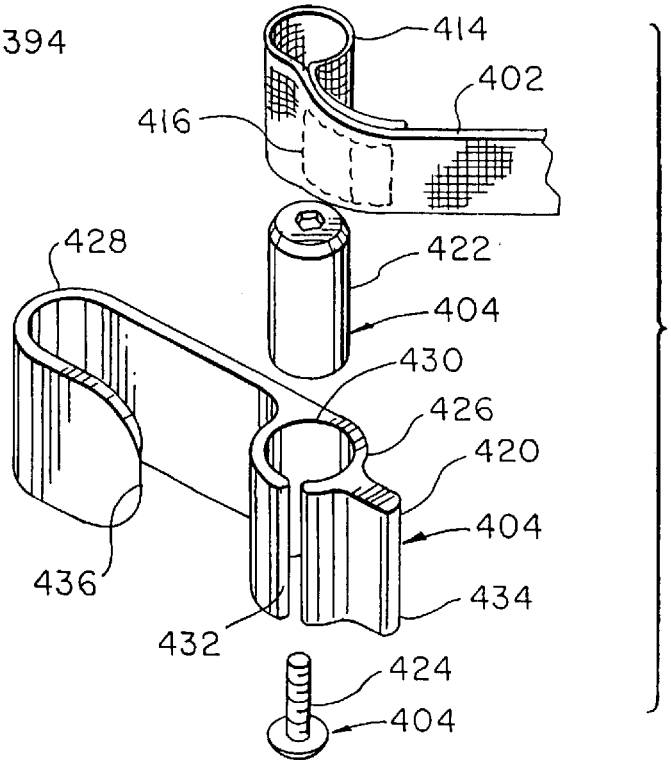
FIG. 15 is an exploded view of the web of FIG. 14 and a transfer hook assembly.
Figure 17:
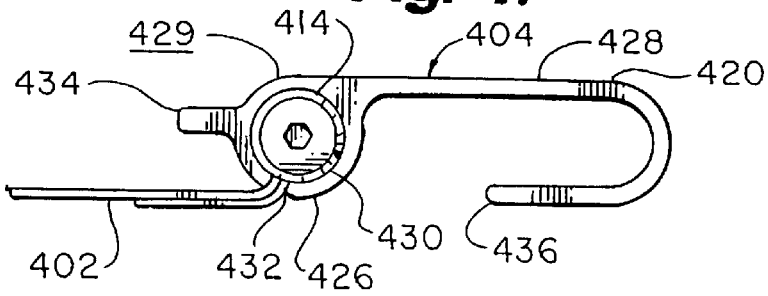
FIG. 17 is a side view of the transfer hook of FIG. 15.

As seen in FIG. 13, each magnetic clutch assembly 350 includes disk 360 and cylindrical housing 362. A generally coaxial bore 364 extends through magnetic clutch assembly 350. In this embodiment, bore 364 has a diameter of about 1/12 inch to accommodate axle 348 and disk 360 has a diameter of approximately 4.9"(±0.5"). Cylindrical housing 362 has a diameter of approximately 4.2"(±0.5") and a depth of approximately 1.8"(±0.5"). An exemplary magnetic clutch develops a torque of 22 lb-ft, and attains a coil power of 28 watts, an armature hub inertia of $161\times10^{-4}$ lb–ft$^2$, a rotor inertia of about $172\times10^{-4}$ lb–ft $^2$, and generates 3 hp at 1800 rpm. Disk 360 may be mounted to outboard surfaces of vertical elements 250 and 252 by fasteners such as screws or bolts. Magnetic clutch assembly 350 is mounted such that axle 348 extends generally coaxially through bore 364. Axle 348 and magnetic clutch 350 may be affixed by a keyway combination (not shown). Each slip plate 352 defines bore 368, a plurality of peripheral holes 370, and presents an inboard surface 372. Magnetic clutch assembly 350 and slip plate 352 are designed to perform a patient displacement so as to provide maximum comfort to the patient. In one embodiment, when magnetic clutch assembly 350 and slip plate 352 are actuated, a gradual acceleration to, and deceleration from, normal operating speed occurs rather than immediate commencement or cessation of normal operating speed, each of which would otherwise result in an abrupt jerk. In yet another embodiment, magnetic clutch assembly 352 and slip plate 352 remain engaged when axle 348 rotation ceases, thereby preventing the web from unwinding from drum assembly 354 until magnetic clutch assembly 350 and slip plate 352 are disengaged.

Each exemplary drum assembly 354 includes cylindrical member 376. Four threaded extensions 378 may extend peripherally from cylindrical member 376 and disk 380 may be unitarily joined to cylindrical member 376. Disk 380 presents an outboard surface and defines a threaded aperture. Cylindrical (spool) member 384 coaxially extends from the outboard surface of disk 380. Outboard disk 385 extends generally coaxially and radially from cylindrical member 384. Outboard disk 385 defines aperture 386 and presents an outboard surface. Aperture 386 is generally aligned with the threaded aperture defined in disk 380 in this embodiment.

Also in this embodiment, a fastener such as a screw extends through each aperture 370 and is threadably disposed within each threaded extension 378. Screw 390 is extended through aperture 386 and is threadably received within the threaded aperture defined in disk 380. Bores are coaxially formed within slip plate 352 and drum assembly 354, respectively, such that axle 348 may be received there within. Drag cap spring 392 is compressibly held in place by drag cap 394. Drag cap 394 cooperates with a fastener such as screw 396 threadably received within an aperture proximate each terminus of axle 348. In this embodiment, power train 106 is dimensioned such that cylindrical members 384 may be spaced between about 18 inches and 22 inches, between about 19 inches and 21 inches, or about 20 inches, on center.

Exemplary hook and web assembly 108 may be seen in FIGS. 1–5, 8–9, 11–12, and 14–20. Referring more particularly to FIGS. 14–17, and 20, hook and web assembly 108 may include web 402, transfer hook assembly 404, stop 406, and an exemplary transfer rod embodiment. However, it is contemplated that other means of securing pliable underlayments such as transfer sheets may be used with this invention. Suitable securing means include various clamps and/or tethers disclosed in above-referenced U.S. Pat. No. 5,737,781. This invention is also contemplated to include securing means disclosed in above-referenced U.S. Provisional Application No. 60/084,519 and U.S. Provisional Application No. 60/092,286. With the exception of stop 406, exemplary hook and web assembly 108 may be substantially equivalent to that disclosed in above-referenced U.S. patent application Ser. No. 09/057,139 and U.S. patent application Ser. No. 09/174,110. First and second loops 412 and 414 are formed at each end of web 402. Loops 412 and 414 are formed by such means known to the art as stitching 416. Exemplary transfer hook assembly 404 includes transfer hook 420, joint connector 422, and joint connecting bolt 424. Exemplary transfer hook 420 is unitary, but may be envisioned as including strap retaining member 426 and hook member 428. Strap retaining member 426 displays exterior surface 429 and defines bore 430 and slot 432. Flange 434 extends from strap retaining member 426. Hook member 428 and strap retaining member 426 cooperate to define gap 436 therebetween. Web 402 is attached to transfer hook 420 by inserting joint connector 422 within loop 414 and disposing loop 414 and inserted joint connector 422 in bore 430 such that web 402 extends through gap 432. Joint connector 422 is then secured within bore 430 by threading joint connector bolt 424 in joint connector 422. Web 402 is attached to drum assembly 354 by aligning loop 412 with aperture 386 and the aperture defined in disk 380, then inserting screw 390 through aperture 386 and loop 412 and subsequently threading screw 390 into the aperture defined in disk 380. Dimensions and materials used in one embodiment of transfer hook assembly 404 may be found in above-referenced U.S. patent application Ser. No. 09/057,139 and U.S. patent application Ser. No. 09/174,110. In one embodiment, web 402 is nylon webbing 1½ inch in width and 73 ¾ inches in length, but is 70 inches in length after loops 412 and 414 are formed.

Figure 20:
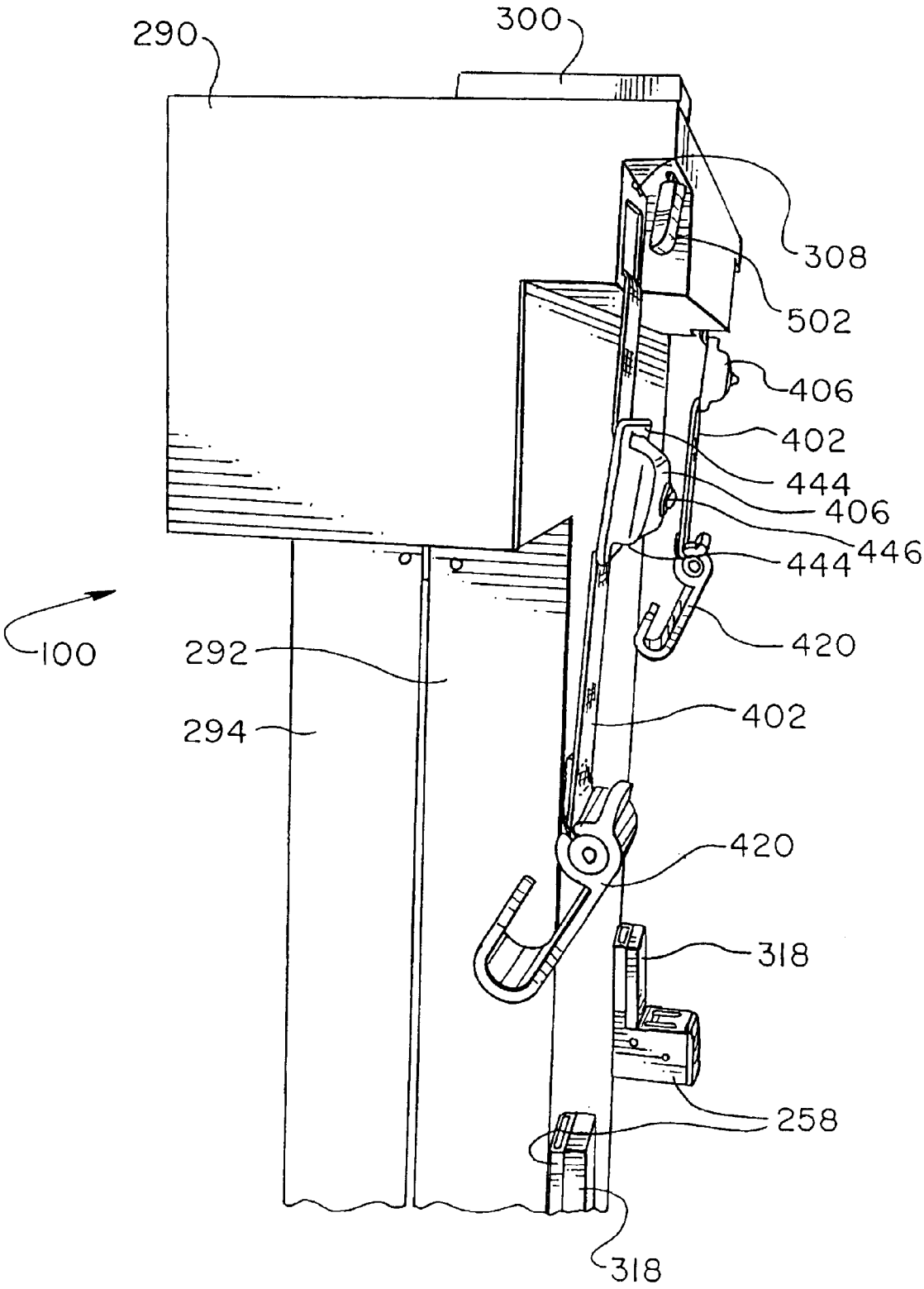
FIG. 20 is a side view of a portion of the embodiment of FIG. 1.
Figure 21:
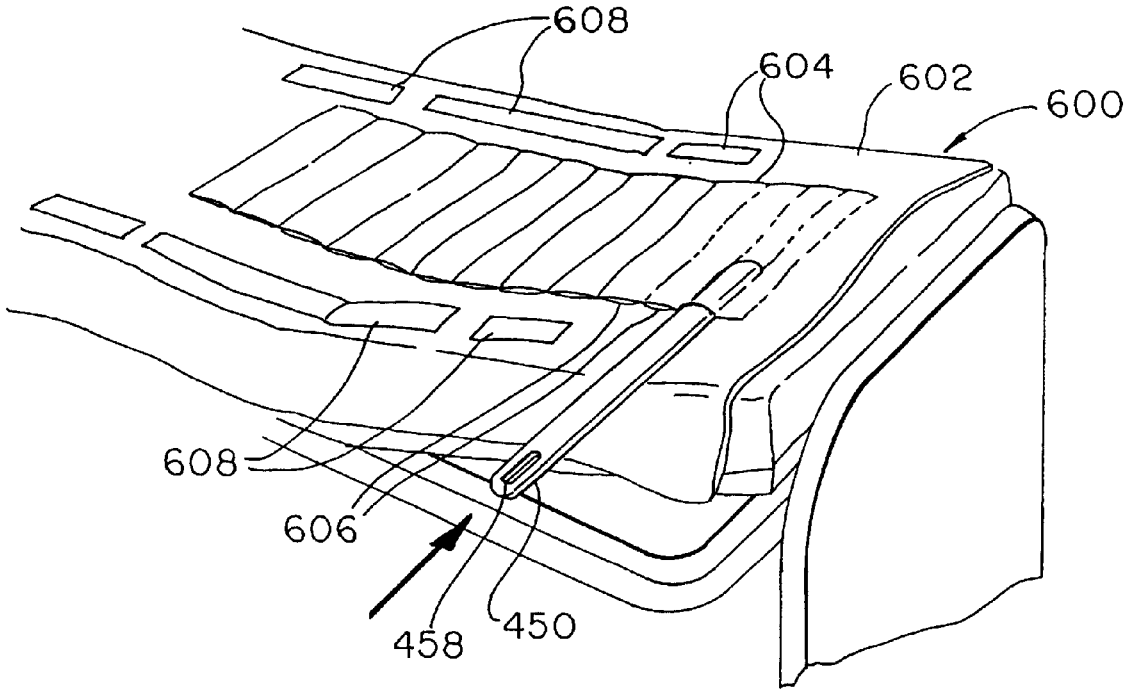
FIG. 21 is a perspective view of a first embodiment of a transfer rod and transfer sheet of this invention.

As seen in FIG. 20, each exemplary stop 406 defines opposite slots 444. Web 402 is passed through slots 444 until stop 406 is a desired distance from transfer hook 420. A fastener such as screw 446 is then extended through web 402 into stop 406 to secure web 402 to stops 406.

Suitable transfer rods of this invention include embodiments such as those designated 450, 452, and 454, depicted in FIGS. 21–24. Transfer rod 450 may be substantially similar to a transfer bar described in U.S. patent application Ser. No. 09/174,110. The transfer rod may be flexible or rigid. Transfer rod 450 defines slots 458 disposed proximate each end of transfer rod 450. Transfer rod 450 is unitary or one-piece in construction, however, other embodiments of transfer rod 450 may be segmented. Slots 458 may be spaced apart between about 16 inches and 24 inches, between about 18 inches and 22 inches, about 20 inches, or about 24 inches, on center. Exemplary transfer bar 450 may be about 1 (±0.25) inch in width, ¼ (±0.25) inch in depth, and between about 24 inches and 32 inches, about 26 inches and 30 inches, or about 28 inches in length. Slots 458 maybe between about 2 inches and 3 inches or about 2.5 inches long and between about 0.25 inches and 0.75 inches or about 0.50 inches wide. Transfer rod 450 is proportioned to be accommodated in a slot in a transfer sheet of this invention, as discussed below. Slots 458 are proportioned to accommodate hook member 428 of transfer hook 420. While slots 458 are depicted being generally centered, slots 458 may be offset toward one edge of transfer rod 450 as well. If offset, slots 458 would tend to maintain transfer bar 450 in a flattened position during a patient displacement event, thereby decreasing the likelihood of transfer rod 450 being bent or causing patient discomfort.

Figure 22:
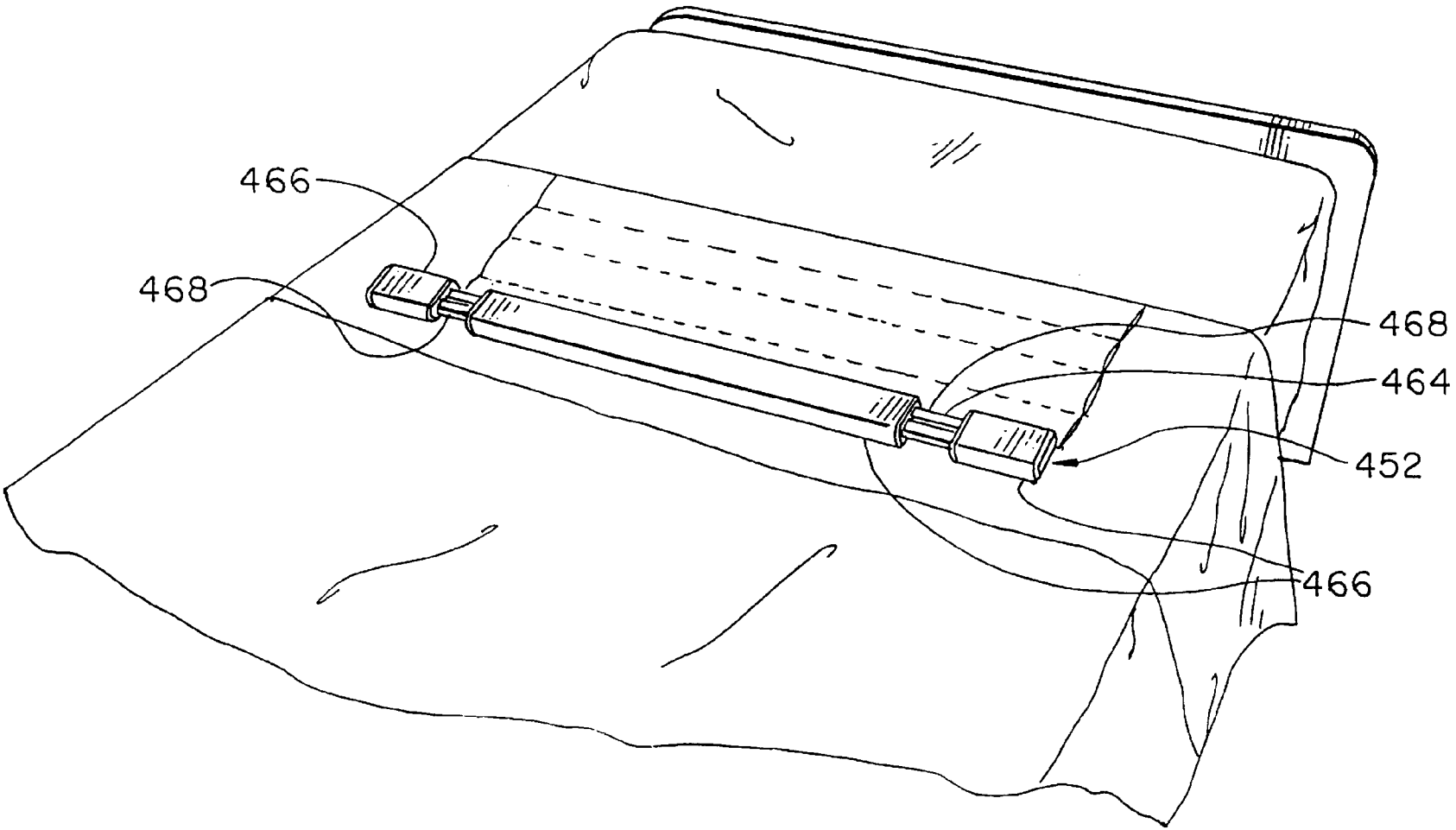
FIG. 22 is a perspective view of a second embodiment of a transfer rod of this invention.

As seen in FIG. 22, exemplary transfer rod 452 includes inner member 464, which is partially enclosed by exterior segments 466. Exterior segments 466 cooperate to define two gaps 468 where inner member 464 is exposed. Inner member 464 is proportioned to be accommodated through gap 436 and within hook member 428 when exemplary transfer rod 452 is enclosed by one or more thicknesses of a sheet or other pliable underlayment wrapped therearound. This embodiment of transferrod 452 is between about 26 inches and 28 inches, or about 27 inches in length. With the exception of length, dimensions and materials of exemplary transfer rod 452 may be substantially similar to those of a transfer rod discussed and depicted in above-referenced U.S. patent application Ser. No. 09/057,139. Gaps 468 may be spaced apart substantially as described above with respect to transfer rod 450.

Exemplary transfer rod 454 includes first and second members 476 and 478 and pivot 480. First and second members 476 and 478 are hingably connected at pivot 480. Respective first and second members 476 and 478 may display interior surfaces 482 and 484. Gripping structures such as extended portion 486 and groove 488 may be present in interior surfaces 482 and 484. Extended portion 486 is proportioned and situated to dispose within groove 488 when transfer 454 is in a closed position. Exterior surfaces of first and second members 476 and 478 may define recesses 490 and 492. Recesses 490 and 492 are aligned to accommodate hook member 428 of transfer hook 420 substantially as discussed above with respect to gaps 468 present in transfer rod 452 when transfer rod 454 is in a closed positioned. Interior surfaces 482 and 484 may further include a grip-enhancing substance, such as polyurethane and other materials known to the art.

Referring to FIGS. 4–5, and 8–12, power and switching system 110 includes power supply assembly 500, circuit board 502, lower switching group 504, and upper switching and indicator group 506. Power supply assembly 500, in tum, includes power supply cord 510 and rectifier 512. Rectifier 512 converts commonly available AC, 60 Hz, 115 V current to DC, 12 V required by motor 340. However, other rectifiers converting other forms of alternating current are contemplated to be within the scope of this invention. Furthermore, other power supply systems such as those depicted and described in above-referenced U.S. patent application Ser. No. 09/057,139 and U.S. patent application Ser. No. 09/174,110 are contemplated to be within the scope of this invention as well.

Figure 10:
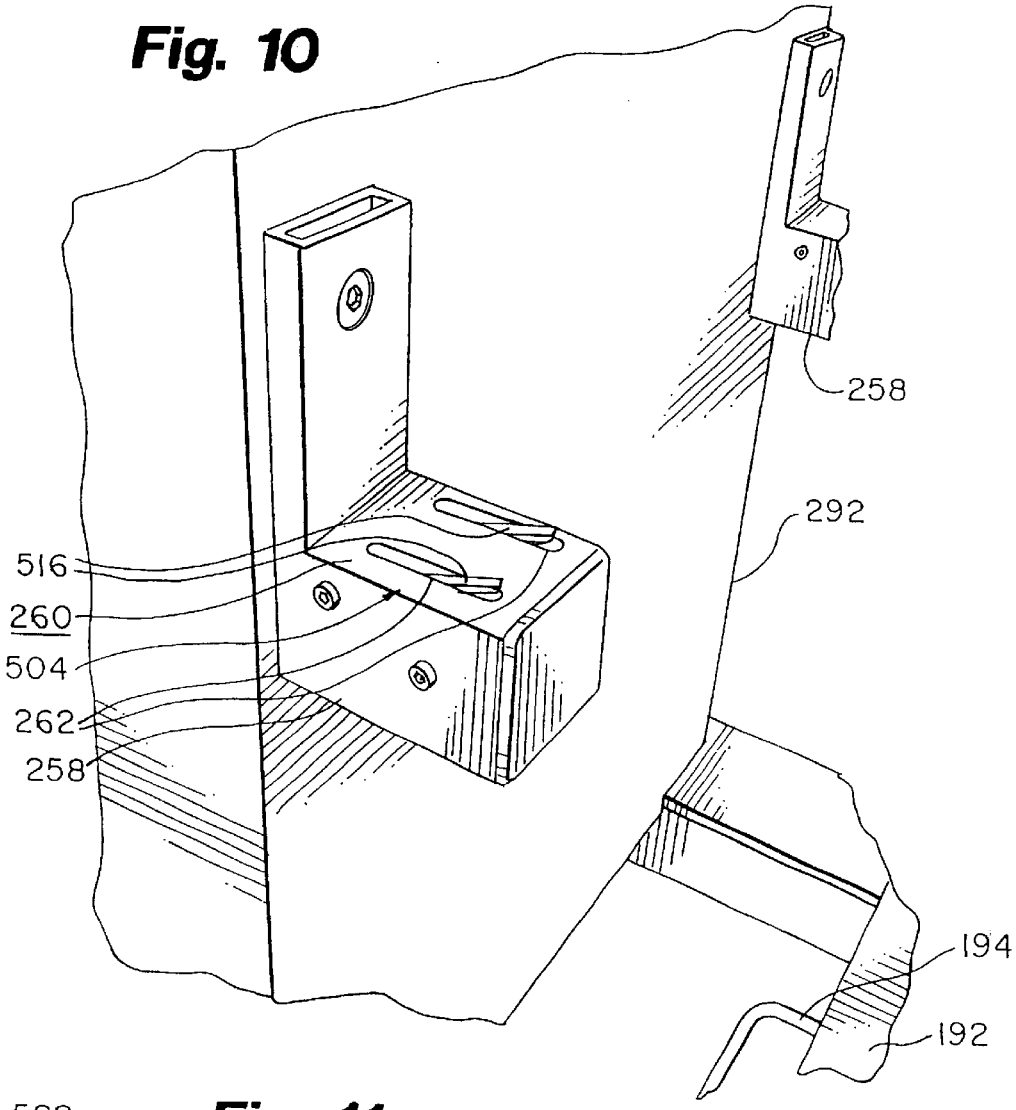
FIG. 10 is a perspective view of part of the embodiment of FIG. 1 depicting a sensing and stabilizer bracket mounted thereon.
Figure 11:
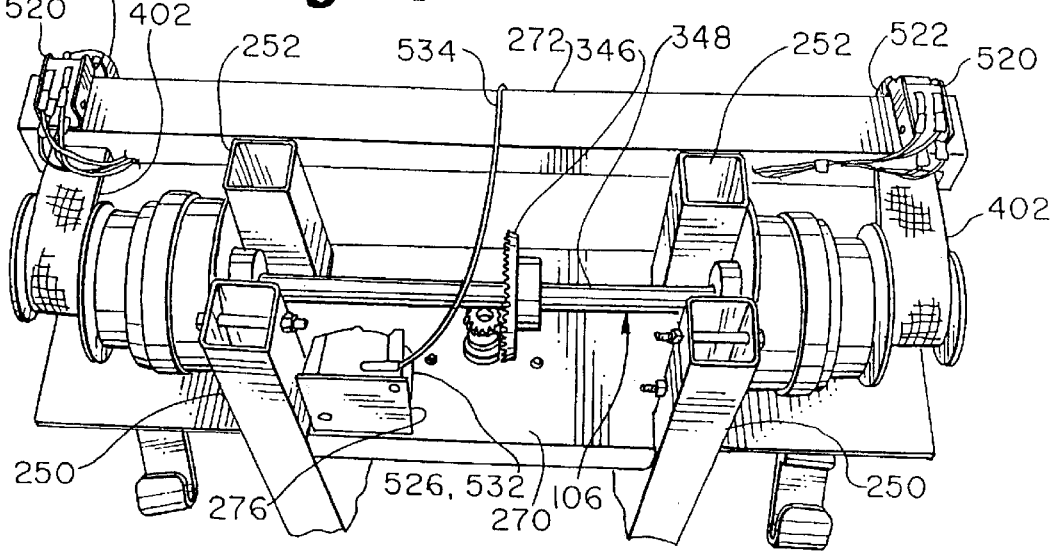
FIG. 11 is a top view of an upper portion of the embodiment of FIG. 1 with the upper shield removed.

As best seen in FIG. 10, lower switching group 504 includes a plurality of stabilizer contact switches 516 present in each bracket 258. Each stabilizer contact switch 516 extends above upper surface 260 and through one of slots 262 defined in bracket 258.

Referring to FIGS. 4, 9, and 11–12, upper switching and indicator group 506 includes proximity switches 520, pivots 522, remote assembly 526 and upper switching and indicator assembly 528. Proximity switches 520 are installed atop front horizontal element 272 and disposed thereon so as to be accommodated by extension 300 of upper shield 290. A pivot 522 may be present and in mechanical communication with each proximity switch 520. Pivot 522 extends over web opening 308 such that pivot 522 will contacted by elements such as stop 406 or flange 434 when web 402 is being wound on drum assembly 354. When thusly contacted, pivot 522 pivots inwardly and engages proximity switch 520. Proximity switches and pivots are also disclosed in above-referenced U.S. patent application Ser. No. 09/057,139 and U.S. patent application Ser. No. 09/174,110.

As seen in FIGS. 9, 11–12, and 24, remote assembly 526 includes remote cord take-up 532, remote cord 534, and remote 536. Remote cord take-up 532 may be affixed to bracket 276 by one or more fasteners such as screws. Remote cord take-up 532 includes a spring-tensioned, take-up assembly (not shown) to store, let out, and retract remote cord 534. The tension exerted by remote cord take-up 532 on remote cord 534 operates to secure remote 536 in remote cavity 302 of upper shield 290 when remote 536 is stored therein.

Remote 536 is in electrical communication with circuit board 502. Remote 536 includes power switch 540, respective left and right clutch switches 542 and 544, optional rollover-mode switch 546, and optional lateral transfer-mode switch 548.

Figure 12:
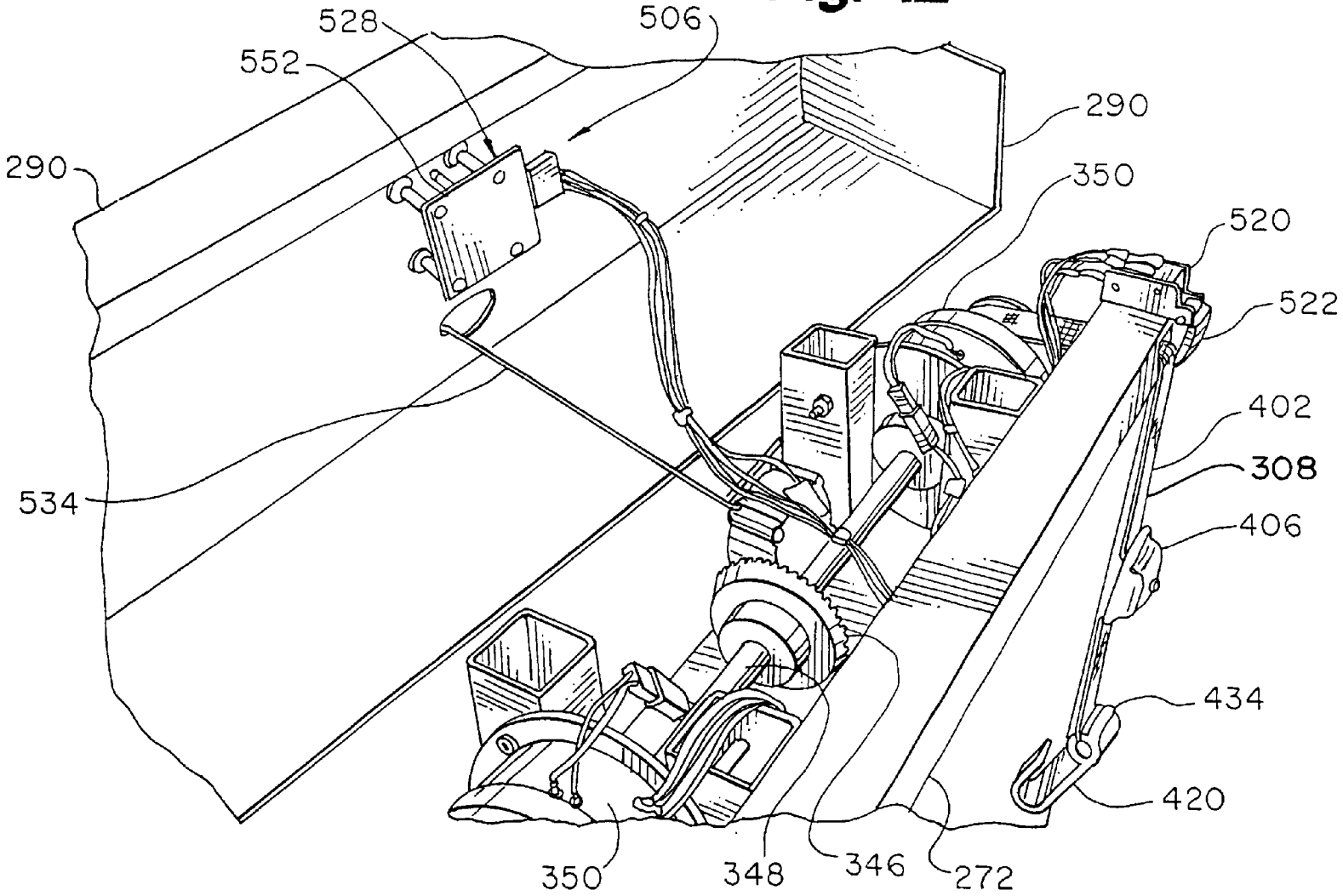
FIG. 12 is a perspective view of part of the upper portion of the embodiment of FIG. 1 with the upper shield removed and depicting a portion of the power and switching system mounted on an inner surface of the upper shield.

Referring to FIGS. 1 and 12, upper switching and indicator assembly 528 includes circuit board 552, power switch 554, power indicator LED 556, and stabilizer switch LED 558. Circuit board 552 is in electrical communication with circuit board 502 and is affixed to an inner surface of upper shield 290 proximate cavities 303, 304, and 306. Power switch 554, power indicator LED 556, and stabilizer switch LED 558 are electrically connected to circuit board 552 and are disposed in respective cavities 303, 304, and 306 defined in upper shield 290.

One embodiment of patient displacing device 100 (excluding transfer rods) is between about 30 inches and 40 inches, between about 35 inches and 38 inches, or about 37.2 inches in height, as measured from an upper surface of extension 300. Upper surfaces 260 of stabilizer brackets 258 extend between about 8 inches and 12 inches, between about 9 inches and 11 inches, or about 10.4 inches vertically from upper surfaces 168 and 170 of left and right base frame members 136 and 138. Stabilizer brackets 258 may be spaced apart between about 10 inches and 11 inches, or about 10.5 inches. A distance from rear tangent 178 to a plane coextending with front edge 174 of front base frame member 139 is between about 19 inches and 23 inches, between about 20 inches and 22 inches, about 21 inches, or about 21.3 inches. When second base assembly is locked into an extended position, the distance between rear tangent 178 and a plane coextending with front surfaces of elements 206 and 208 are between about 29 inches and 33 inches, between about 30 inches and 32 inches, about 31 inches, or about 31.3 inches. Exemplary patient displacing device 100 is contemplated to include embodiments in which a ratio of the heightat which web 402 emerges from spool 384 to the distance from rear tangent 178 to a plane coextending with front edge 174 of front base member 139 to be between about 1.61 and 1.95, between about 1.68 and 1.85, about 1.76, or about 1.74. Exemplary patient displacing device 100 is further contemplated to include embodiments in which a ratio of the height at which web 402 emerges from spool 384 to the distance between rear tangents 178 to a plane coextending with the front surfaces of elements 206 and 208 to be between about 1.12 and 1.28, between about 1.16 and 1.23, about 1.19, or about 1.18.

Figure 26:
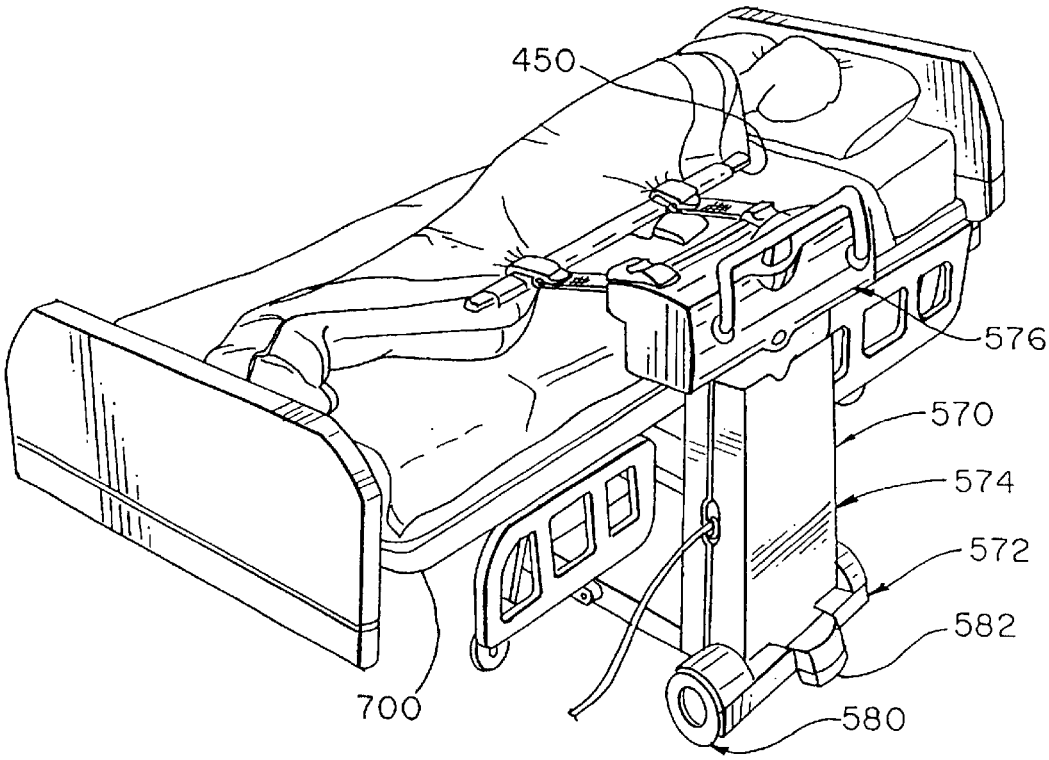
FIG. 26 is a perspective view of a second embodiment of the patient displacing device of this invention being used in a patient rollover.
Figure 27:
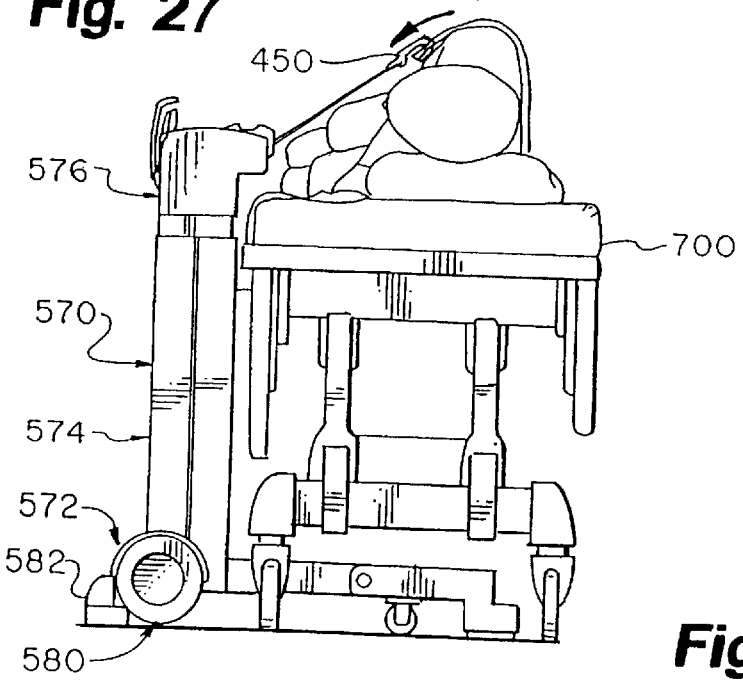
FIG. 27 is a front view of the device of FIG. 26.

Referring to FIGS. 26 and 27, an alternative embodiment of the patient displacing device of this invention is depicted at 570 and includes base 572, middle portion 574, and upper portion 576. Base 572 includes wheel and axle assembly 580 and vertical control mechanism 582. Increased wheel width of wheel and axle assembly 580 may add enhanced stability to patient displacing device 570. In contrast to patient displacing device 100, device 570 includes vertically adjustable upper portion 576. The height of upper portion 576 is controlled by operating vertical control mechanism 582. Suitable alternative power train embodiments to enable vertically adjustable upper portion are disclosed in above-referenced U.S. patent application Ser. No. 09/057,139 and U.S. patent application Ser. No. 09/174,110.

Patient displacing devices 100 and 570 are advantageously used to displace patients disposed on supports such as beds, gurneys, and the like. Supports used with the patient displacing device of this invention may be conformable to a generally horizontal position. These supports may include head portions which can be raised and lowered as well.

Patient displacing device 100 may be operated using a pliable underlayment such as a transfer sheet between a patient and the patient support. Such a pliable underlayment (transfer/draw sheet) is depicted generally at 600 in FIG. 21. Draw sheet 600 includes mantle 602 and at least one attaching member 604. Exemplary attaching member 604 cooperates with mantle 602 by being attached thereto by attaching means such as stitching to define respective lateral and longitudinal slots 606 and 608. Slots 606 and 608 are proportioned in width to receive any of transfer rods 450, 452, or 454. Slots 606 and 608 are defined so as to have a width between about 2 inches and 3 inches, or about 2.5 inches, in this embodiment. Exemplary lateral and longitudinal slots 606 and 608 are respectively about 20 inches and 65 inches in length. However, other suitable dimensions are contemplated to fall within the scope of this invention. Moreover, any arrangement and spacing with respect to lateral slots 606 to enable three patient pullups without repositioning pliable underlayment 600 under a patient is further contemplated to be within the scope of this invention. Such an arrangement includes a series of between about 15 and 23 or about 19 lateral slots 606. The series of lateral slots 606 may extend between about 46 and 50 inches, between about 47 and 49 inches, about 48 inches, about 48.625 inches along transfer sheet 600. The series of lateral slots 606 may be separated from one edge of transfer sheet 600 from about 10 inches to about 14 inches, about 12 inches, or about 12.7 inches. Longitudinal slots 608 may be used to cooperate with patient displacing device 100 or 570 when laterally transferring a patient or rolling a patient over. This embodiment of draw sheet 600 is about 60 inches in width and about 114 inches in length. However, other suitable dimensions are contemplated to be within the scope of this invention. Suitable materials and other embodiments for draw sheet 600 are disclosed in above-referenced U.S. patent application Ser. No. 09/174,110.

Figure 31:
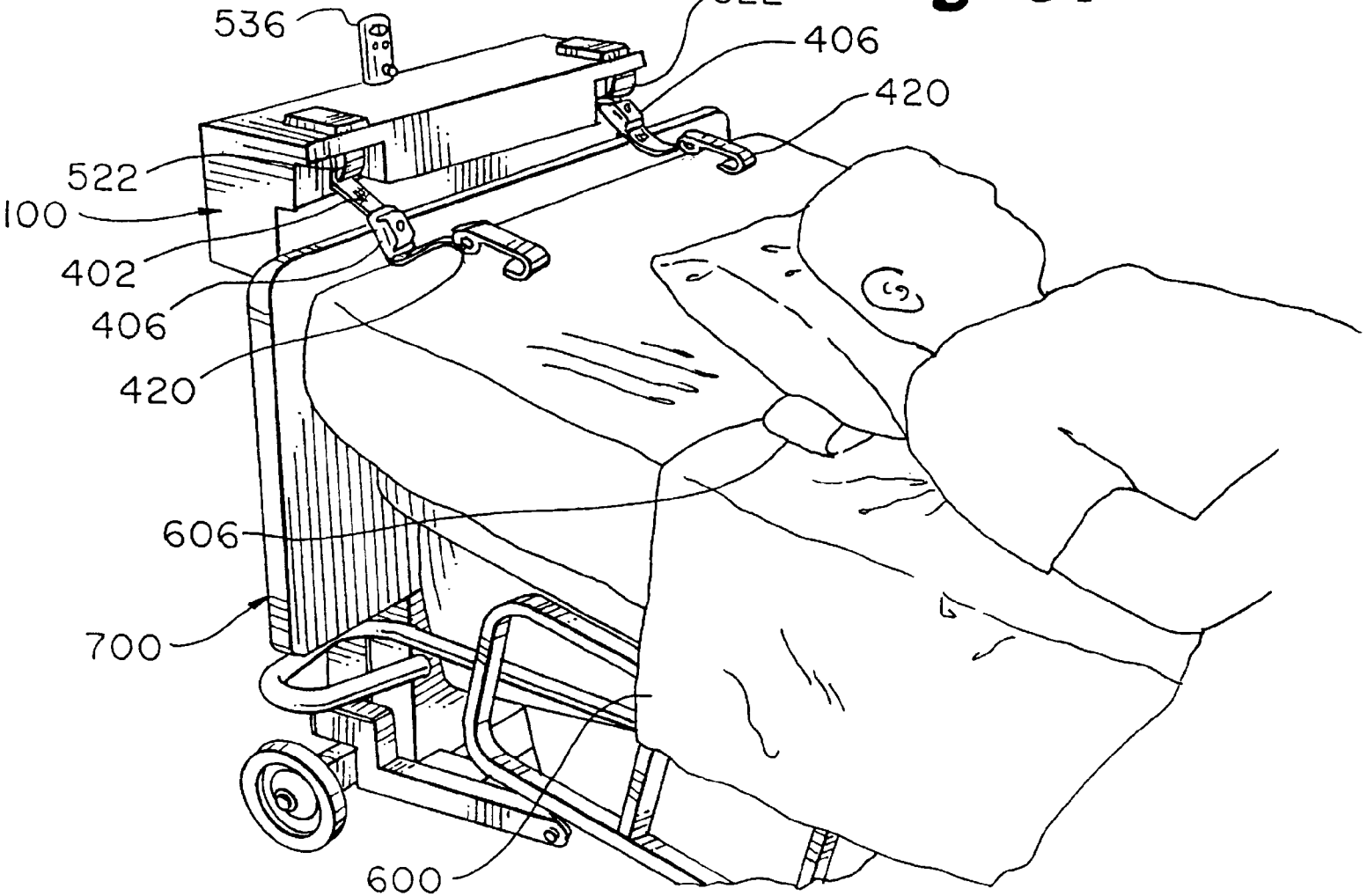
FIG. 31 is a perspective view of the device of FIG. 1 in cooperation with a bed, positioned for a patient pullup.
Figure 32:
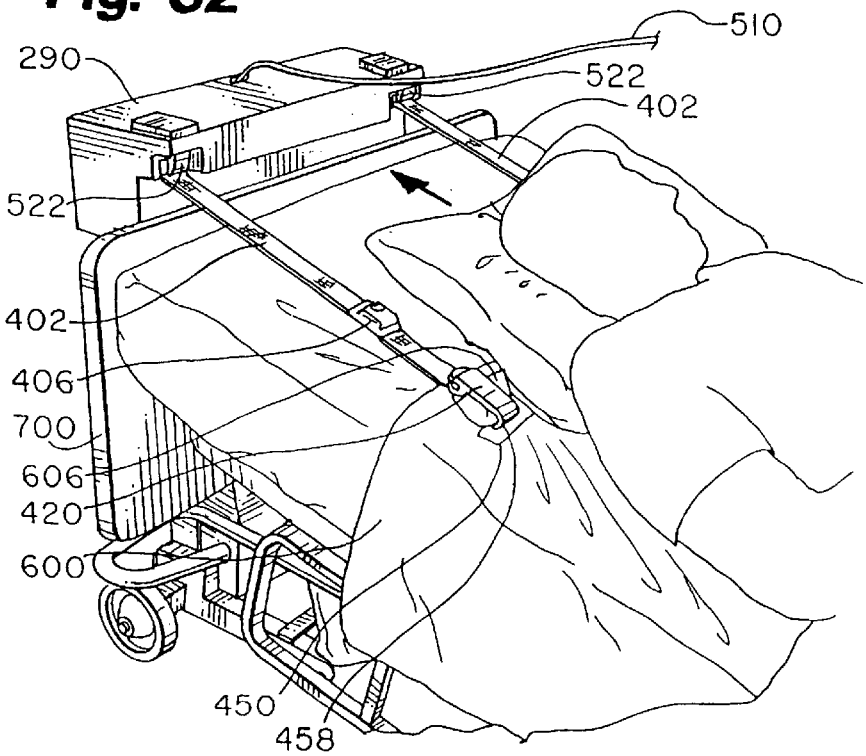
FIG. 32 is a perspective view of the device of FIG. 1 connected to a transfer sheet and performing a patient pullup.

In use, patient displacing device 100 or 570 is deployed at the head of a patient support such as bed 700 as shown in FIGS. 31 and 32. Bed 700 is displaced a distance away from a wall or other vertical structure and patient displacing device 100 is rolled therebetween. Once patient displacing device 100 is in proper position, locking mechanisms on casters 152 may be engaged. If present, second base assembly may be pivoted and locked into an extended position as discussed and explained above. Power supply cord 510 is plugged in to an AC receptacle. Exemplary patient displacing device 700 is configured such that it will not operate until power supply cord 510 is plugged in to an active AC outlet. Bed 700 is then moved toward patient displacing device 100. The head portion of bed 700 may be in a raised position. The head portion of bed 700 is then lowered until a member of bed 700 contacts one or both brackets 258, thereby engaging one or more stabilizer contact switches 516. When brackets 258 are engaged thusly, patient displacing device 100 or 570 is further stabilized.

Once stabilizer contact switches 516 are engaged the circuitry present within patient displacing device 100 allows the unit to be powered by switches 540 or 554. Moreover, once power has been switched on, indicator LED 554 activates, thereby indicating bed 700 is securely engaged to patient displacing device 100. If bed 700 subsequently fails to engage stabilizer contact switches 516, indicator LED 556 will go out and power will be disconnected to power train 106.

Transfer rod 450 may be disposed in one of slots 606 of transfer sheet 600. Web 402 is unwound until transfer hook 420 can be inserted into each slot 458. Transfer rod 450 may be disposed in a slot 606 such that transfer rod 450 is approximately below the patient's neck. Respective left and right clutch switches 542 and 544 may be engaged separately or together as needed as the patient is evenly repositioned during the pullup event. If switches 542 and 544 are not released, stops 406 will engage pivots 522. When pivots 522 are engaged, magnetic clutch assemblies 350 will cease operation and web 402 ceases to be wound onto drum assembly 354. If for some reason stop 406 is not present on web 402, flange 434 of transfer hook 420 will also contact pivot 522 as well.

Figure 18:
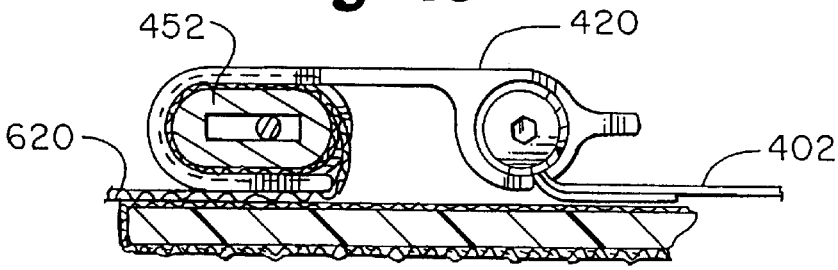
FIG. 18 is a side view of the transfer hook of FIG. 14 disposed about a transfer rod, the transfer rod wrapped in a pliable underlayment.
Figure 19:
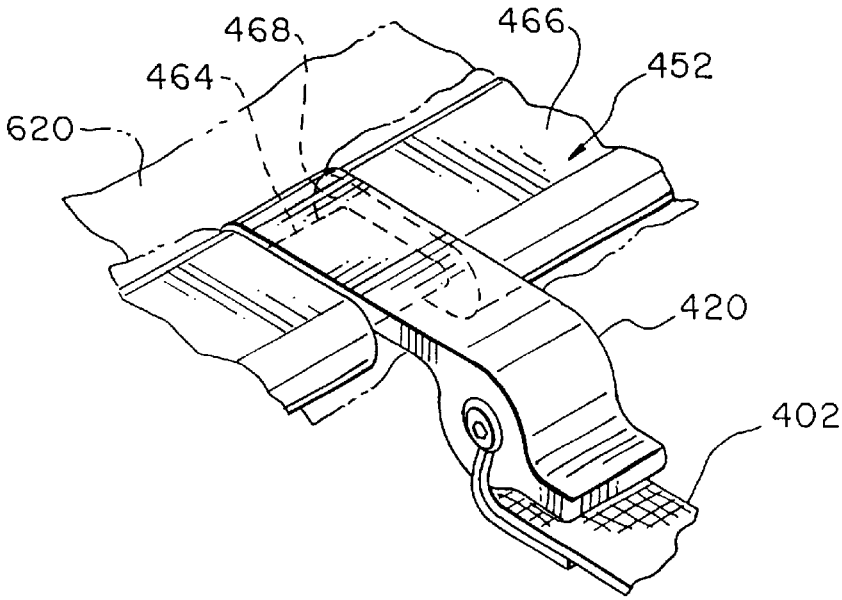
FIG. 19 is a perspective view of the transfer hook and transfer rod of FIG. 18.
Figure 33:
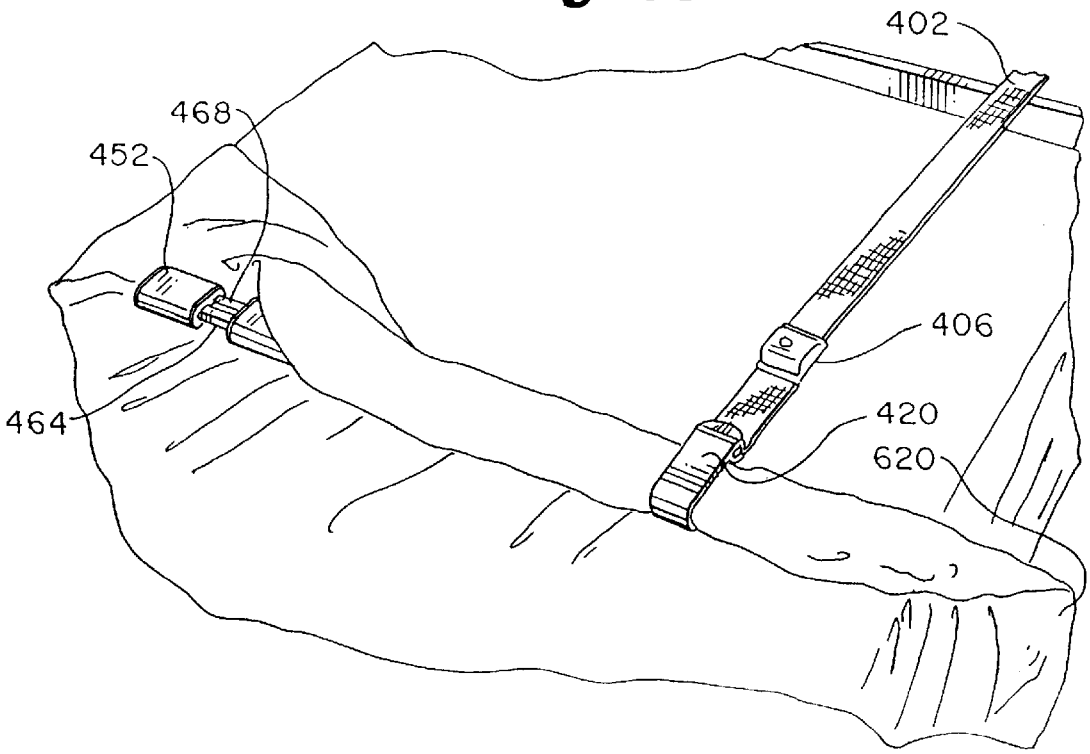
FIG. 33 is a perspective view of the transfer rod of FIG. 22 depicted within a transfer sheet.

Transfer rods 452, 454 and 583 (discussed below) may be employed in conjunction with transfer sheet 600 or the like. However, transfer rods 452, 454 and 583 are also useful in effecting a patient displacing event without such a slotted sheet. As shown in FIGS. 18–19, and 33, transfer rod 452 is positioned above a patient's head on a sheet without slots, indicated as 620. Sheet 620 is then folded over transfer rod 452. Transfer rod 452 is then rotated toward the patient one or two revolutions. Transfer hook 420 is then engaged in each of gaps 464 and patient pullup may proceed as described above.

Figure 23:
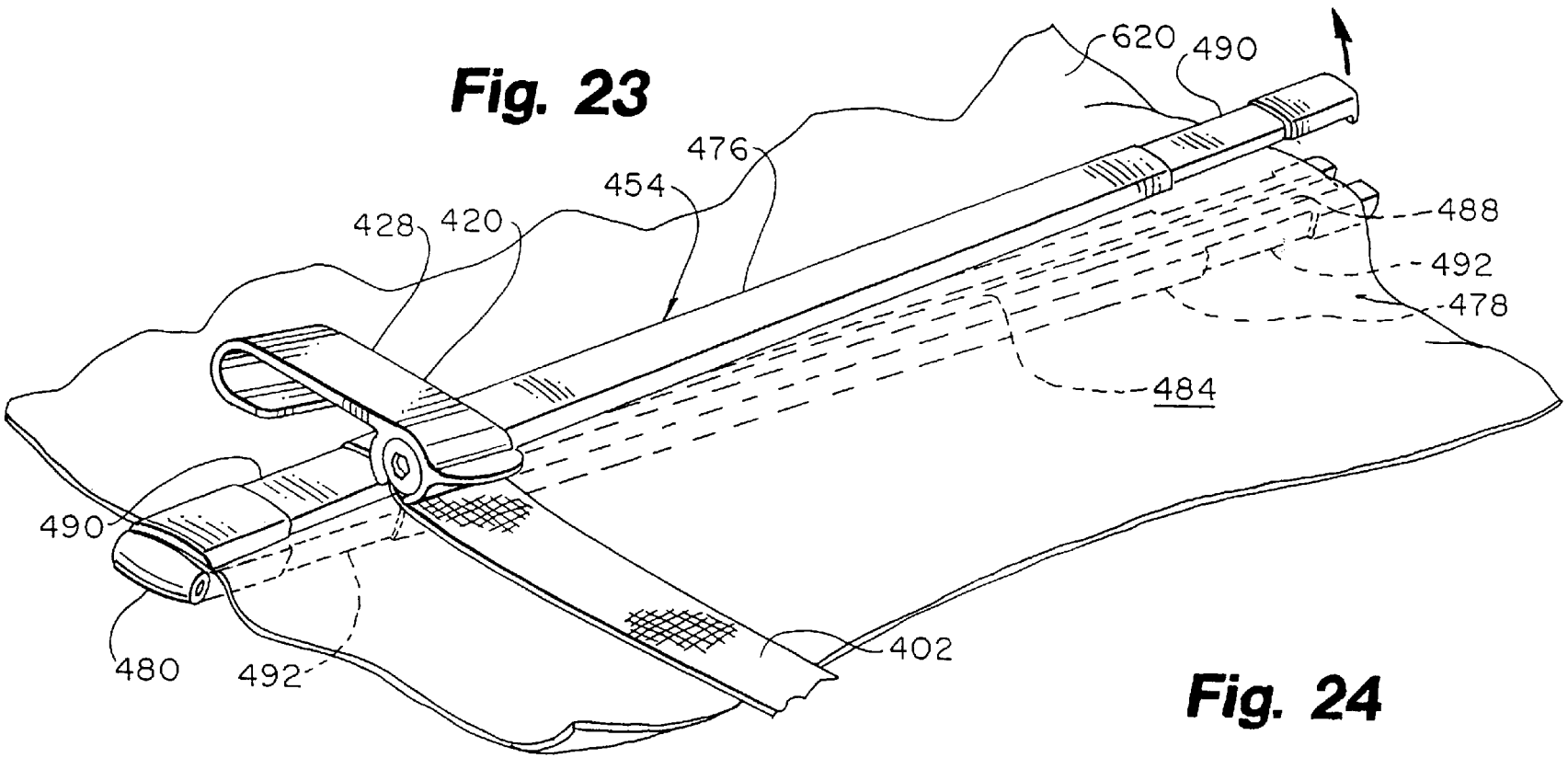
FIG. 23 is a perspective view of a third embodiment of a transfer rod of this invention.
Figure 24:
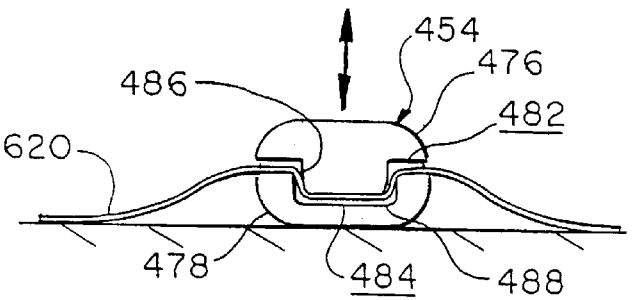
FIG. 24 is an end view of the transfer rod of FIG. 23 taken from the end opposite the pivot.
Figure 25:
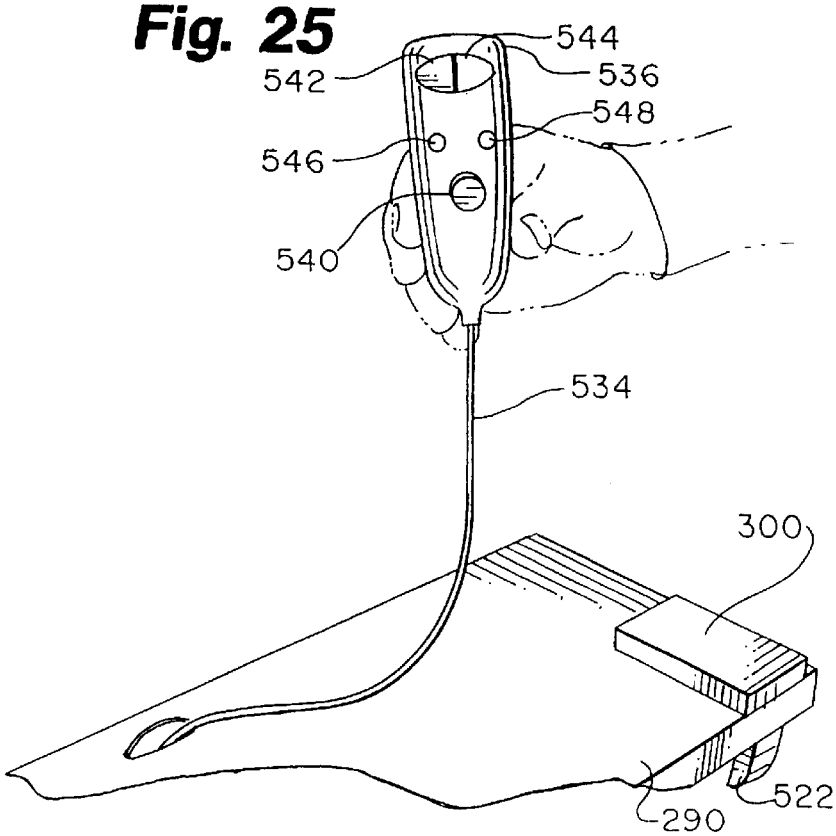
FIG. 25 is a perspective view of an embodiment of a remote control means of the embodiment of FIG. 1.

Transfer rod 454 is another embodiment advantageously used in connection with sheet 620 and seen in FIGS. 23 and 24. First and second members 476 and 478 are pivoted apart and a portion of sheet 620 above the patient's head is disposed therebetween. First and second members 476 and 478 are then pivoted together until they contact sheet 620. First and second members 476 and 478 may be dimensioned such that sheet 620 is securely held therewithin by extended portion 486 and groove 488 when recesses 490 and 492 are disposed within hook 420. Alternatively, once sheet 620 is disposed between closed first and second members 476 and 478, transfer rod 454 may be rolled one or more turns toward the patient before attaching transfer hook 420.

Figure 29:
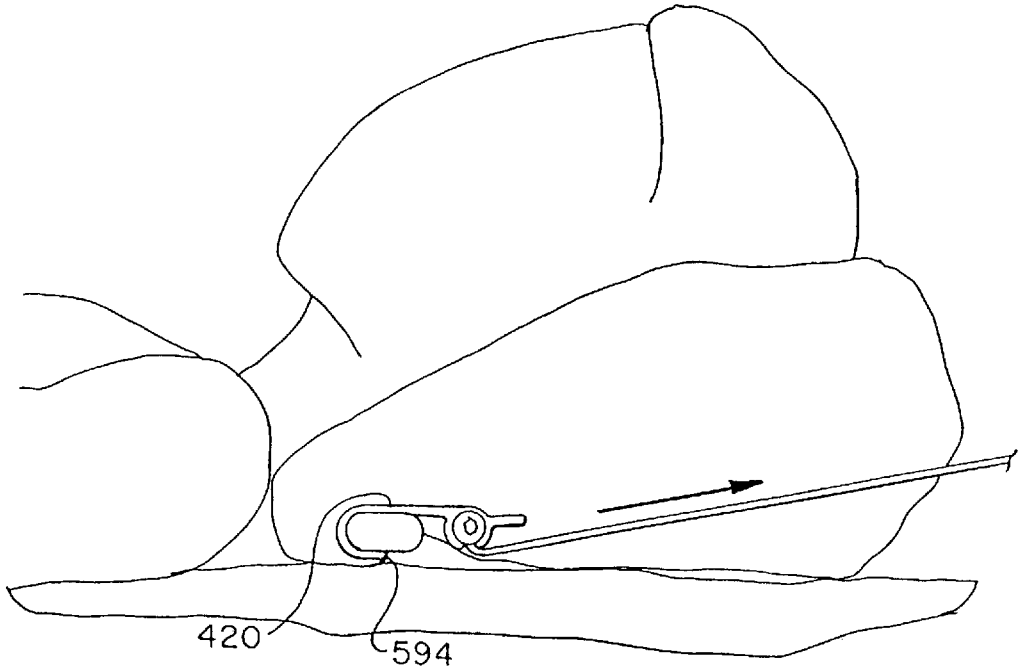
FIG. 29 is an end view of the transfer rod of FIG. 28 being used to effect a patient pullup.
Figure 30:
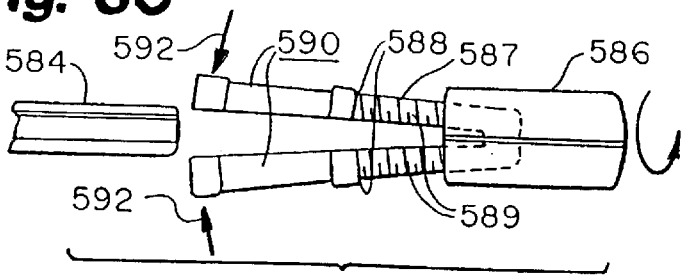
FIG. 30 is a view of a portion of the transfer rod of FIG. 28.
Figure 28:
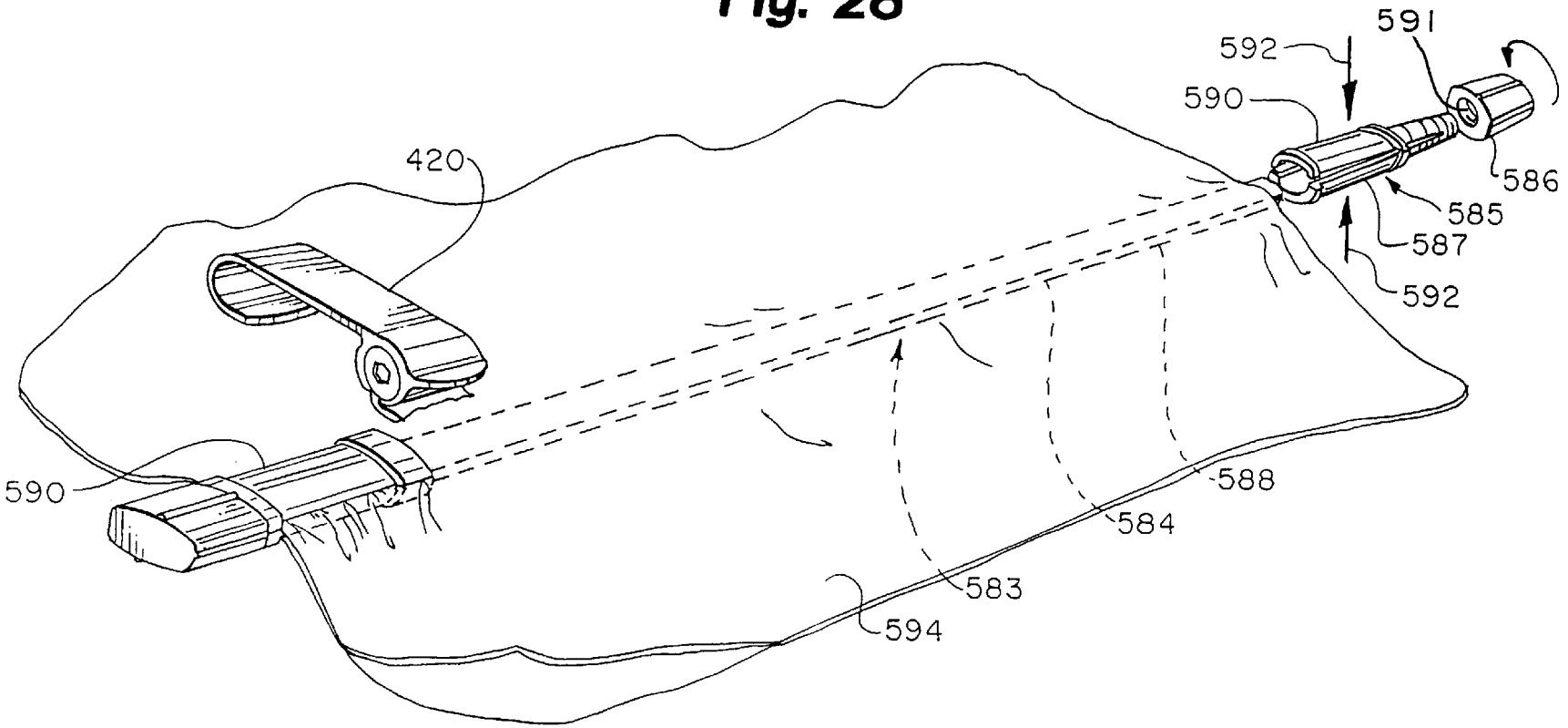
FIG. 28 is a perspective view of a fourth embodiment of a transfer rod of this invention.

Transfer rod 583 is yet another embodiment which may be used during a patient pullup. Referring to FIGS. 28–30, exemplary transfer rod 583 includes longitudinal element 584 and clamp 585. Clamp 585 includes first member 586 and second member 587. Second member 587 is divided into a plurality of furcations 588, each furcation 588 displaying threaded surface 589 and attaching surface 590. Furcations 588 are biased away from each other. First member 586 defines threaded orifice 591.

In use, longitudinal element 584 is placed on a pliable underlayment such as draw sheet 594 and a clamp 585 is disposed on each end of longitudinal element 584 such that one furcation 588 contacts the topside of longitudinal element 584 and one furcation 588 contacts sheet 594 such that sheet 594 is disposed between furcation 588 and longitudinal element 584. Sheet 594 extends between furcations 588 when second member 587 is disposed as described. First member 586 is then threaded onto second member 587 forcing furcations 588 toward each other in the direction of arrows 592, securing sheet 594 between furcation 588 and longitudinal element 584. Longitudinal element 584 and furcations 588 are dimensioned such that transfer hook 420 is accommodated by attaching surfaces 590 when longitudinal element 584 and clamps 585 are properly fitted together to secure sheet 594. Alternatively, once longitudinal element 584 and clamps 585 have been secured together, transfer rod 583 may be rotated until sheet 594 is wrapped one or more times therearound. An alternate embodiment of transfer rod 583 includes furcations 588 which extend at least one-half of the length of longitudinal element 584. Yet another alternate embodiment of transfer rod includes at least one second member 587 with three or more furcations.

Patient displacing device 100 or 570 may also be advantageously used in connection with a patient rollover or lateral transfer. During a rollover or lateral transfer, transfer rods such as exemplary transfer rods 450, 452, 454, or 583 may be employed. However, transfer rods employed thusly may be longer. Moreover, when used during a rollover event, transfer rods with some degree of flexibility may impart a greater degree of comfort to the patient.

As seen in FIGS. 26 and 27, during a rollover patient displacing device 100 or 570 is positioned proximate a lateral side of a patient support such as bed 700. Bed 700 is then lowered until an element or member of bed 700 contacts stabilizer contact switches 516 and bracket 528, thereby stabilizing device 100. Patient displacing device 100 or 570 may be further stabilized by extending second base assembly 128 and locking casters 152 as described above. Alternatively, embodiments of this invention in which brackets 258 may be vertically adjusted are also contemplated. If vertically adjustable embodiments of brackets 258 are present, the patient displacing device of this invention may be stabilized by elevating the vertically adjustable brackets until they contact a patient support member. After patient displacing device 100 or 570 is stabilized, power supply cord 510 is plugged in and power switches 540, 554 are engaged as described above.

If a slotted transfer sheet, such as sheet 600, is used, transfer rod 450 or a longer embodiment of transfer rod 450 is disposed in a longitudinal slot 608 on the opposite side of the patient from that occupied by patient displacing device 100 or 570. Hooks 420 are then disposed in slots 458 of transfer rod 450 and clutch switches 542 and/or 544 are activated until the patient has been rolled to the desired extent. A pillow or some other object may then be placed against the patient's back before hooks 420 are disconnected from transfer rod 450. In an alternative embodiment, optional rollover-mode switch 546 is depressed before the rollover event is initiated. In the rollover-mode of operation, magnetic clutch assemblies 350 and slip plates 352 cease to wind web 402 on drum assembly 354 yet remain engaged, thereby preventing the patient from rolling back into the previous position. Transfer rods such as those resembling transfer rods 452, 454, or 583 may be used for rollovers as well.

Transfer rods 450, 452, 454, or 583 may further be employed to effect a lateral transfer from one patient support, such as a bed, to another patient support such as a bed or gurney. During a lateral transfer, the support onto which the patient is to be transferred is placed between patient displacing device 100 or 570 and the support onto which the patient is then disposed. The support onto which the patient is to be transferred is then lowered until a lower member or element contacts bracket 258, thereby stabilizing device 100 or 570 as described above. Patient displacing device 100 or 570 may be further stabilized by locking second base assembly 128 in an extended position also as described above. A transfer rod resembling transfer rods 450, 452, 454, or 583 may be attached to the sheet, or other pliable underlayment, onto which the patient is disposed. Webs 402 are unwound from drum assemblies 354 until transfer hooks 420 are close enough to engage the transfer rod secured to the sheet. Power switch 540 or 554 is then activated and the engaging LED 558 is examined by the attendant to ensure that device 100 has been properly stabilized. If device 100 has been properly stabilized, LED 558 is lit and the attendant operates either or both of clutch switches 542 and 544 to effect the transfer. Switches 542 and 544 are released when the patient has been transferred. Alternatively, stops 406 or flanges 434 of hooks 420 engage pivots 522 to halt the patient transfer.

Because numerous modifications may be made of this invention without departing from the spirit thereof, the scope of the invention is not to be limited to the embodiments illustrated and described. Rather, the scope of the invention is to be determined by appended claims and their equivalents.

What is claimed is:

1. A device for maneuvering a patient positioned on a support, an underlayment being disposed proximate the patient and the support, the device being operable by a single person and comprising:

a power train;

connecting assembly means attachable to the power train for connecting the power train to the underlayment upon which the patient is at least partially positioned; and a power and switching system in electrical communication with the power train and comprising means for stabilizing the device, said stabilizing means actuated by contact with a first member of the support and in electrical communication with the power and switching system.

2. The device of claim 1, said device being configured to maneuver patients positioned on a patient support which is configurable to a generally horizontal position by cooperating with the underlayment disposed between the patient and the support.

3. The device of claim 2, in which the stabilizing means comprises at least one extension, the extension accommodating a first switch actuating the power and switching system.

4. The device of claim 2, in which the stabilizing means comprises a docking mechanism accommodated by the support.

5. The device of claim 2, in which the connecting assembly means comprises a hook and web assembly comprising at least one belt and at least one hook, each belt being attachable to the power train and to one of said hooks.

6. The device of claim 5, the hook and web assembly comprising a plurality of belts and a plurality of hooks, each belt attachable to the power train and to one of said hooks.

7. The device of claim 6, in which the power train is configured such that the plurality of said belts are placed between about 18 inches and 22 inches apart.

8. The device of claim 6, in which the power train is configured such that the plurality of said belts are disposed about 20 inches apart.

9. The device of claim 5, further comprising a first base member, a middle portion extending from the first base member and an upper portion extending from the middle portion, the power train, hook and web assembly, and power and switching system are disposed proximate the middle and upper portions.

10. The device of claim 9, in which the middle portion accommodates at least a portion of the stabilizing means.

11. The device of claim 9, in which the middle portion accommodates a bracket housing an activation sensor switch in electrical communication with the power and switching system, the activation sensor switch actuating the power and switching system when the activation sensor switch is in a closed position.

12. The device of claim 11, in which the activation sensor switch and bracket housing cooperate such that the activation sensor switch is in the closed position when an upper surface of the bracket contacts a portion of the support.

13. The device of claim 11, in which the bracket housing is vertically adjustable.

14. The device of claim 9, further comprising a second base member extendible from the first base member.

15. The device of claim 14, in which a forward edge of the second base member is extendible from a forward edge of the first base member for a distance of between about 9 and 11 inches.

16. The device of claim 14, in which a forward edge of the second base member is extendible from a forward edge of the first base member for a distance of about 10 inches.

17. The device of claim 9, in which the first base member is between about 16 inches and 20 inches in length.

18. The device of claim 9, in which the first base member is about 18 inches in length.

19. The device of claim 15, in which a front edge of the second base member is between about 26 inches and 30 inches from a rear edge of the first base member when the second base member is in an extended position.

20. The device of claim 15, in which a front edge of the second base member is about 28 inches from a rear edge of the first base member when the second base member is in an extended position.

21. The device of claim 15, further comprising a plurality of rear wheels and in which said device is configured such that a forward edge of the first base member extends a distance of between about 20 inches and 22 inches from an adjacent vertical structure when said rear wheels contact the vertical structure.

22. The device of claim 21, in which said device is configured such that a forward edge of the extended second base member extends a distance of between about 30 inches and 32 inches from an adjacent vertical structure.

23. The device of claim 21, in which said device is configured such that a forward edge of the extended second base member extends a distance of about 31.3 inches from a vertical structure.

24. The device of claim 15, in which the hook and web assembly comprises a plurality of belts and hooks, each belt attachable to one of the hooks and to the power train, and each hook comprises an extension, and the power and switching system comprises a plurality of proximity switches, each proximity switch being located adjacent the upper portion and disposed to be actuated by contacting the hook extension.

25. The device of claim 15, in which the hook and web assembly comprises a plurality of belts, hooks, and engagement members, each hook and engagement member attachable to one of the belts and each belt attachable to the power train, and the power and switching system comprises a plurality of proximity switches, each proximity switch configured and disposed to be actuated by contacting the engagement member.

26. A transfer rod, in combination with the device of claim 6, the transfer rod comprising means for accommodating the plurality of hooks.

27. The transfer rod of claim 26, comprising a plurality of pivotably connectible rod sections configured to secure the pliable underlayment therebetween.

28. The transfer rod of claim 26, the hook accommodating means comprising a plurality of slots, each slot accommodating one of said hooks.

29. The transfer rod of claim 26, the hook accommodating means comprising an exterior surface accommodating one of said hooks.

30. A pliable underlayment, in combination with the transfer rod and the device of claim 26, the pliable underlayment comprising:

a mantle proportioned to accommodate at least a central portion of the patient's body; and an attaching structure operably adjacent the mantle.

31. The pliable underlayment of claim 30, in which the attaching structure comprises a plurality of slots proportioned to accommodate the transfer rod.

32. The pliable underlayment of claim 31, in which at least one of the slots extend generally parallel to a pliable underlayment longitudinal axis.

33. The pliable underlayment of claim 31, in which at least one of the slots extend generally transverse to a pliable underlayment longitudinal axis.

34. A method of maneuvering a patient positioned on a support, an underlayment being disposed between at least a portion of the patient and the support, the method comprising:

providing a device operable by a single person, the device comprising:

a power train, connecting means for connecting the power train and a patient supporting underlayment, and a power and switching system in electrical communication with the power train and means for stabilizing the device;

fastening the connecting means to the underlayment; and actuating the power train to wind the connecting means thereon to achieve maneuvering of the patient from a first position to a second position.

35. The method of claim 34, in which the power train is actuated by a remote switch.

36. The method of claim 34 wherein the maneuvering of the patient from a first position to a second position includes a rollover of the patient.

37. The method of claim 34 wherein the maneuvering of the patient from a first position to a second position includes a lateral movement of the patient.

38. The method of claim 34 wherein the maneuvering of the patient from a first position to a second position includes a pullup of the patient.

* * * * *